US011524417B2

(12) United States Patent
Panagiotopoulou et al.

(10) Patent No.: US 11,524,417 B2
(45) **Date of Patent: *Dec. 13, 2022**

(54) SHAVER WITH SENSORS AND METHODS FOR PROVIDING A SHAVING LUBRICANT HAVING A SMART POLYMER

(71) Applicant: Bic Violex S.A., Anoixi (GR)

(72) Inventors: Vasiliki Panagiotopoulou, Anoixi (GR); Athanasia Panou, Anoixi (GR); Panagiotis Moustakas, Anoixi (GR); Georgios Pyrris, Anoixi (GR)

(73) Assignee: BIC Violex Single Member S.A., Anoixi (GR)

( * ) Notice: Subject to any disclaimer, the term of this patent is extended or adjusted under 35 U.S.C. 154(b) by 0 days.

This patent is subject to a terminal disclaimer.

(21) Appl. No.: 17/305,068

(22) Filed: Jun. 30, 2021

(65) Prior Publication Data

US 2021/0323179 A1 Oct. 21, 2021

Related U.S. Application Data

(63) Continuation of application No. 16/622,654, filed as application No. PCT/EP2018/064423 on Jun. 1, 2018, now Pat. No. 11,084,179.

(Continued)

(51) Int. Cl.

| | |
|---|---|
| ***B26B 19/40*** | (2006.01) |
| ***B26B 21/40*** | (2006.01) |
| ***B26B 21/44*** | (2006.01) |

(52) U.S. Cl.

CPC ..... *B26B 19/40* (2013.01); *B26B 21/4056* (2013.01); *B26B 21/443* (2013.01)

(58) Field of Classification Search

CPC combination set(s) only.

See application file for complete search history.

(56) References Cited

U.S. PATENT DOCUMENTS

| | | | |
|---|---|---|---|
| 2004/0074097 | A1 | 4/2004 | Guimont et al. |
| 2008/0016692 | A1 | 1/2008 | Noble |

(Continued)

FOREIGN PATENT DOCUMENTS

| | | | |
|---|---|---|---|
| CN | 204260633 | U | 4/2015 |
| GB | 2417007 | A | 2/2006 |
| WO | 2016124405 | A1 | 8/2016 |

OTHER PUBLICATIONS

International Search Report and Written Opinion issued in related International Application No. PCT/EP2018/064423, dated Sep. 17, 2018 (8 pages).

(Continued)

*Primary Examiner* — Jennifer S Matthews

(74) *Attorney, Agent, or Firm* — Bookoff McAndrews, PLLC

(57) ABSTRACT

A system and a method for adaptively releasing a lubricant or a cosmetic for a razor cartridge, a sensing unit detects a property of at least one of skin, air, water and a chemical agent in a region adjacent to the razor cartridge. A smart polymer provided on the razor cartridge is selectively responsive to a characteristic external stimulus by undergoing a physical or chemical change. A processing unit controls the release of the lubricant or the cosmetic by providing the characteristic external stimulus to cause the smart polymer to undergo a change. The processing unit compares the detected property to a reference threshold parameter and determines whether to provide the characteristic external stimulus to the smart polymer based on the comparison, thereby generating the lubricant or the cosmetic. The determined level of depletion of the smart polymer is indicated by a light, aural, or haptic indication.

20 Claims, 14 Drawing Sheets

Related U.S. Application Data

(60) Provisional application No. 62/534,722, filed on Jul. 20, 2017, provisional application No. 62/526,642, filed on Jun. 29, 2017.

(56) References Cited

U.S. PATENT DOCUMENTS

| | | | |
|---|---|---|---|
| 2013/0145623 | A1 | 6/2013 | Wain |
| 2015/0047202 | A1 | 2/2015 | Rosemberg et al. |
| 2017/0291319 | A1 | 10/2017 | Hendriks et al. |

OTHER PUBLICATIONS

Office Action issued in Chinese Patent Application No. 201880031864.6, dated Mar. 29, 2021 (4 pages).
Search Report issued in Chinese Patent Application No. 201880031864.6, dated Mar. 21, 2021 (1 page).

SHAVER WITH SENSORS AND METHODS FOR PROVIDING A SHAVING LUBRICANT HAVING A SMART POLYMER

CROSS REFERENCE TO RELATED APPLICATIONS

This application is a continuation of U.S. patent application Ser. No. 16/622,654, now U.S. Pat. No. 11,084,179, issued, Aug. 10, 2021, entitled "Shaver with Sensors and Methods for providing a Shaving Lubricant having a Smart Polymer", which claims benefit to 35 U.S.C. § 119(e) of U.S. Provisional Patent Application Ser. No. 62/534,722, entitled "System and Method for Providing a Shaving Lubricant Having a Smart Polymer," filed on Jul. 20, 2017, and U.S. Provisional Patent Application Ser. No. 62/526,642, entitled "Shaver with Sensors and Related Methods of Use," filed on Jun. 29, 2017, which are hereby incorporated by reference

BACKGROUND OF THE DISCLOSURE

1. Field of the Disclosure

The present disclosure relates to a shaving razor having a cartridge containing one or more blades and a lubricating strip. More particularly, the present disclosure relates to a system and method for providing a shaving lubricant using a lubricating strip provided on the cartridge, which lubricating strip contains a smart polymer.

2. Description of the Related Art

A user of a shaving razor is faced with the problem of providing an optimum environment for shaving, e.g., ideal water temperature and skin lubrication to achieve a close shave while reducing discomfort and the risk of injury. A lubricating strip may be provided on the cartridge of the shaving razor to release a lubricant, e.g., polyethylene oxide, during shaving. However, the effectiveness of the lubricating strip is influenced by the ambient condition(s), e.g., water temperature, air temperature and/or pH of water and/or skin, which ambient condition(s) may not be readily controllable by a user of the shaving cartridge in certain situations. Therefore, there is a need for a system and a method for at least (i) adaptively releasing lubricants in accordance with changes in the ambient conditions, and (ii) notifying a user when to replace a cartridge that has depleted the lubricant supply, which system and method eliminate the issues now faced by a user during shaving.

SUMMARY

The present disclosure provides a system and a method for at least adaptively releasing lubricants in accordance with changes in the ambient condition(s).

The present disclosure further provides such a system and a method for notifying a user when to replace a cartridge that has depleted the lubricant supply.

The present disclosure also provides a system and a method to (i) determine ambient condition(s), e.g., water temperature, air temperature and/or pH of ambient material, and (ii) adaptively activate a lubricating strip formed at least in part by a "smart" polymer, such that a chemical and/or physical change in the smart polymer results in a lubricant being generated from the smart polymer material itself.

The present disclosure also provides a shaver including one or more sensors, e.g., proximity and/or pH sensors, data from which sensors may be used to adapt (e.g., dynamically) aspects (e.g., operating characteristics) of the shaver based on various factors, such as the pH of the user's skin and the pH of the water or rinsing agent used for shaving. Aspects of the shaver that may be customized include, but are not limited to, physical or chemical characteristics of shaver.

The present disclosure further provides such a system and method in which the smart polymer also functions as a matrix for holding a secondary lubricant, in which case the lubricant generated from the smart polymer material is supplemented by the secondary lubricant.

As used herein, the term "smart polymer" or "stimuli-responsive polymer" may refer to high-performance polymers that change their properties in response to the environment they are in. "Smart" polymers are artificial materials designed to respond in a particular manner when exposed to at least one environmental stimulus. In many cases, a slight change in environment stimulus is sufficient to induce a large change in the smart polymer's property. Stimuli-responsive polymers may be sensitive to various factors, such as temperature, humidity, ion strength, salinity, pH, redox status, force, pressure (e.g., weight), electrochemical stimuli, the wavelength or intensity of light, intensity of an electrical or magnetic field. In response to the factors, stimuli-responsive polymers may change one or more properties such as hydrophobicity, lubricity, color, transparency, conductance, permeability to water, shape, hardness, conformation, adhesiveness, or water retention.

The present disclosure provides for such smart polymers that include, but are not limited to: polyethylene glycol; polyethylene-polypropylene glycol; poly(N-isopropylacrylamide); homologous N-alkyl acrylamides; polyanhydrides; polyacrylic acids; poly(methyl methacrylates); cyclodextrin; and dendrimers.

The present disclosure further provides such a system and a method to determine at least one environmental condition (e.g., temperature and/or pH) of the shaving area of the skin, e.g., temperature of the skin, temperature of the water, temperature of air in the shaving area, and/or pH of the material in the shaving area of the skin, and utilize the determined environmental condition(s) in combination with the smart polymer(s).

The present disclosure still further provides such a system and a method in which the detected environmental condition can be used by a control element (e.g., in the shaver or separate from the shaver) that generates an activation signal to activate a smart polymer to respond to the detected environmental condition.

The present disclosure also provides such a system and a method to objectively determine a level of smart polymer remaining on the shaving cartridge by using an electrochemical detection system.

The present disclosure further provides such a system and a method to objectively determine a level of smart polymer remaining on the shaving cartridge by using an image detection system.

The present disclosure still further provides a system and a method to objectively determine a level of smart polymer remaining on the shaving cartridge and notify a user of the cartridge regarding the determined level of smart polymer remaining on the shaving cartridge.

The present disclosure further provides a notification unit comprising at least one of (i) a light indication unit configured to output information regarding the determined level of smart polymer remaining, (ii) an aural indication unit configured to output information regarding the determined level of smart polymer remaining, and (iii) a haptic indication unit configured to output information regarding the determined level of smart polymer remaining. In this manner, the user will objectively know the level of smart polymer remaining.

The present disclosure still further provides a notification unit comprising at least one of (i) a light indication unit configured to output information regarding when to replace the shaving cartridge, (ii) an aural indication unit configured to output information when to replace the shaving cartridge, and (iii) a haptic indication unit configured to output information regarding when to replace the shaving cartridge.

The present disclosure yet further provides a system and a method to objectively determine a level of smart polymer remaining on the shaving cartridge so that information regarding the determined level of smart polymer can be cumulatively collected, stored, and/or analyzed by a control and/or analysis unit to determine how quickly the smart polymer is depleted and/or how frequently the razor needs to be replaced for a particular user.

BRIEF DESCRIPTION OF THE DRAWINGS

A component or a feature that is common to more than one drawing is indicated with the same reference number in each of the drawings.

DETAILED DESCRIPTION OF THE DISCLOSURE

Figure 1:
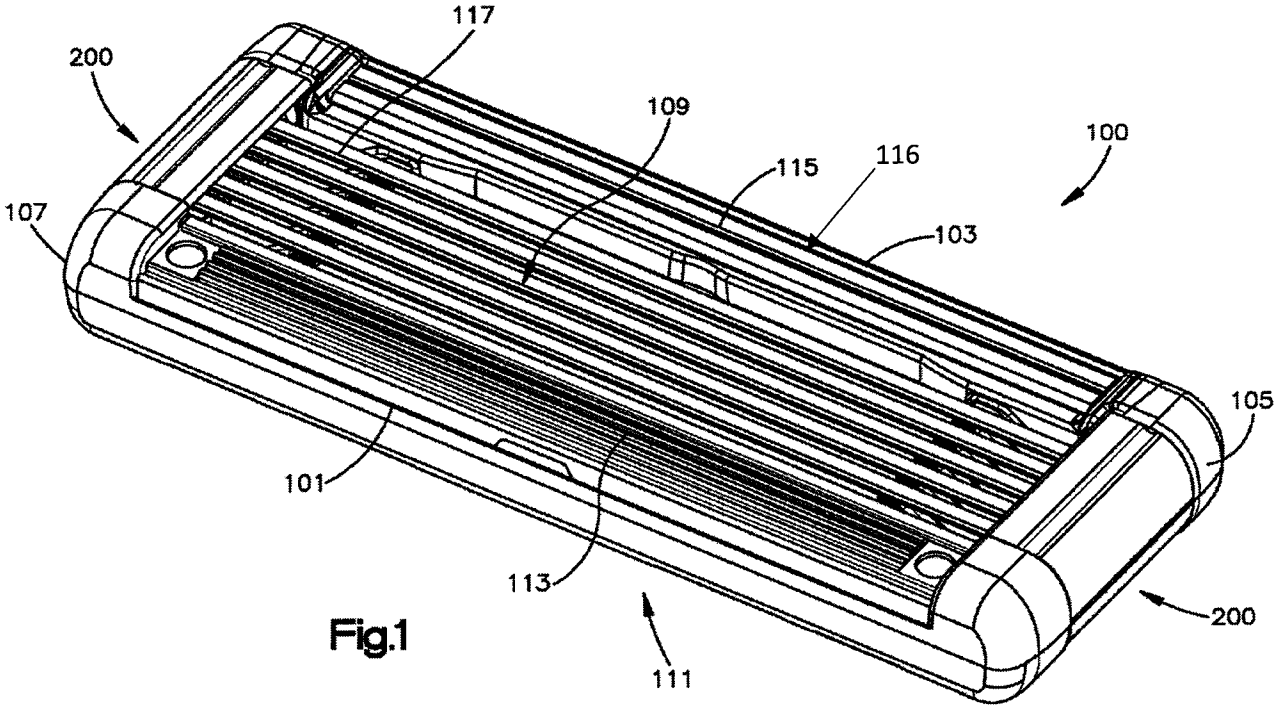
FIG. 1 is a perspective view of an example of a shaving cartridge.

Referring to the drawings and, in particular to FIG. 1, a shaving cartridge is shown and generally represented by reference numeral 100. Shaving cartridge 100 includes retainers 200 for securing blades 117 to shaving cartridge 100. Shaving cartridge 100 also has a housing having a front edge 101, a rear edge 103, a pair of side edges 105, 107, a top surface 109, and a bottom surface 111. The pair of side edges 105, 107 extend between front edge 101 of the housing and rear edge 103 of the housing. Shaving cartridge 100 includes a guard bar 113 adjacent to front edge 101 of the housing and a cap 115 adjacent to rear edge 103 of the housing. A lubricating strip 116 can be provided on the surface of the cap 115. One or more blades 117 are positioned between the guard bar 113 and cap 115, and retained in position in the housing using one or more retaining element(s), e.g., a pair of retainers 200 positioned in the housing. Although shaving cartridge 100 shown in FIG. 1 includes five blades 117 retained in position in the housing using a pair of retainers 200, any number of blades can be used and any number and/or type of retaining element(s), e.g., one or more retaining clips, can be provided at suitable location(s) to retain the blade(s) in position. In addition, although the lubricating strip 116 is shown in the example as being provided on the cap 115, the lubricating strip 116 may be provided on any other area of the cartridge, e.g., on the guard bar 113 and/or on the retainer(s) 200.

Figure 2:
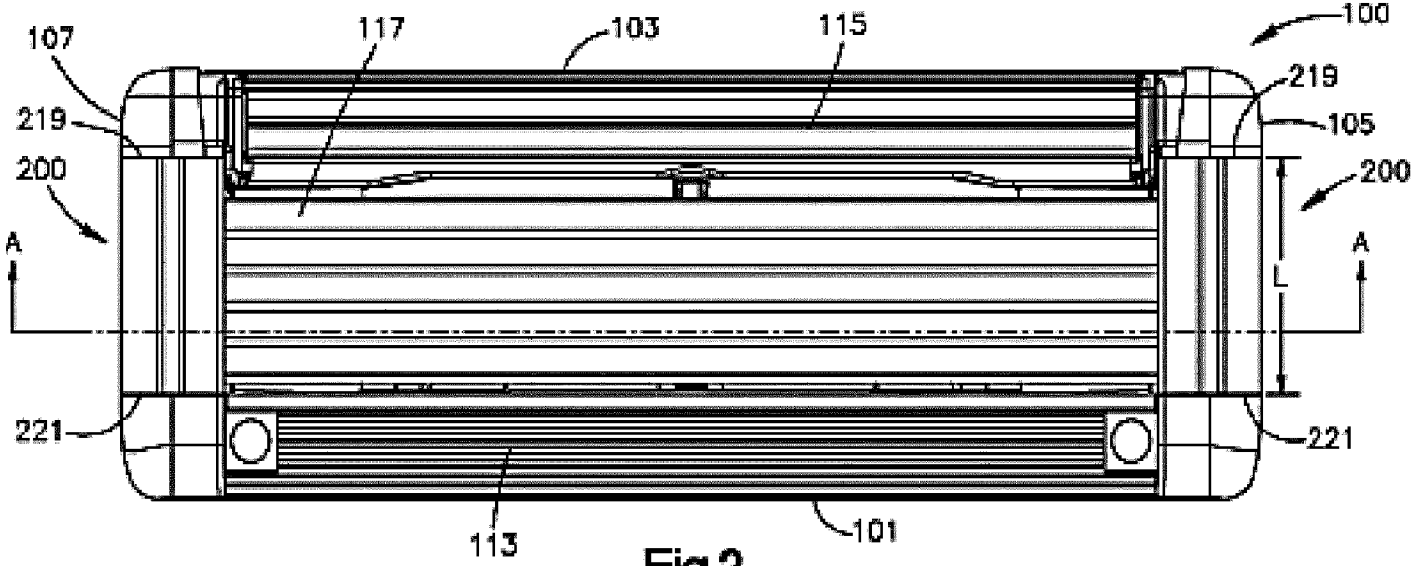
FIG. 2 is a top view of the shaving cartridge.
Figure 3:
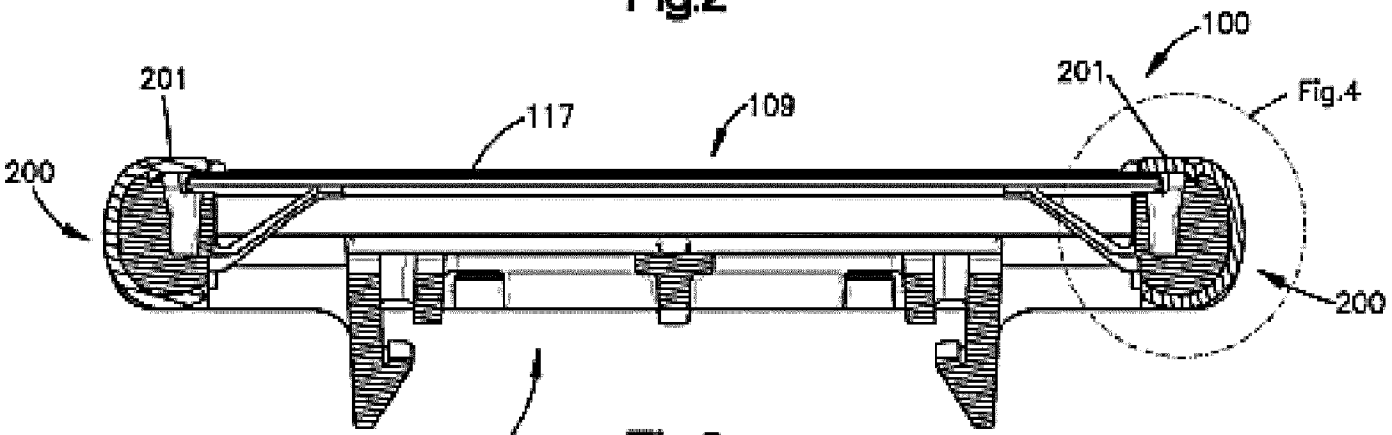
FIG. 3 is a cross-sectional view of the shaving cartridge along the line A-A in FIG. 2.

Referring to FIGS. 2-3, retainers 200 are spaced apart and positioned on opposite sides of the housing. Retainers 200 extend along side edges 105 and 107 of the housing and include a top portion 201 that extends above top surface 109 of the housing and above one or more blades 117 to retain the position of blades 117 in the housing. Retainers 200 can be made of metal. Retainers 200 physically contact blades 117, so that retainers 200 and one or more of the blades 117 can form an electrical path.

In this embodiment, retainers 200 extend along a length L on side edges 105 and 107 of about 8.5 mm, for example. However, it should be appreciated that retainers 200 can extend along a shorter or longer portion of side edges 105 and 107. For example, a pair of retainers 200 can each extend along the entire length, a shorter portion, or a longer portion of side edges 105 and 107. Such extensions can secure in place a guard bar, a cap element, or a trimmer assembly, for example. In addition, as noted above, any number of retainers 200 can be used with shaving cartridge 100. For example, a single retainer or four retainers 200 can be used to retain the position of blades 117 in the housing.

Figure 4:
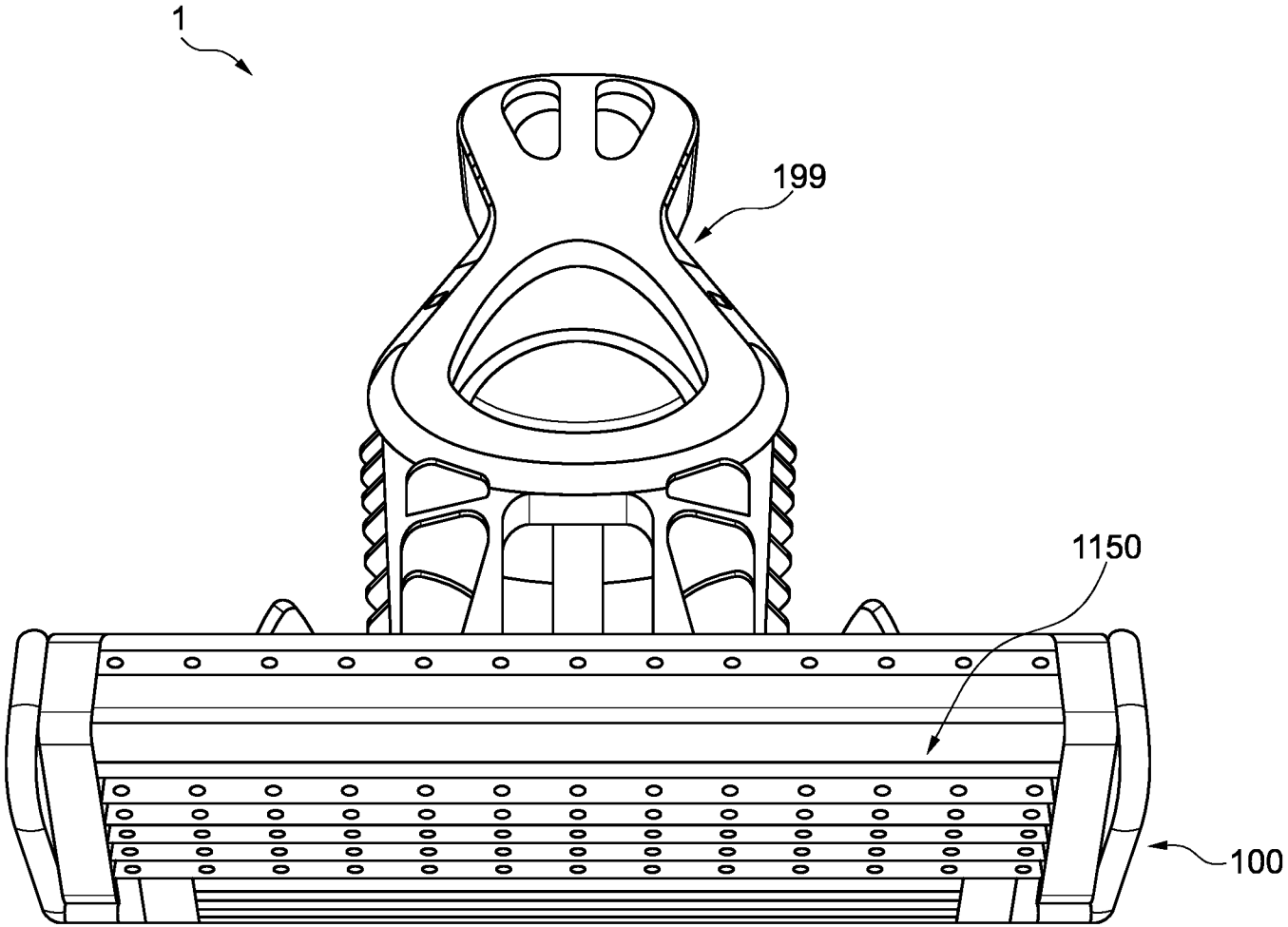
FIG. 4 is a perspective view of a razor having a handle and a shaving cartridge.
Figure 5:
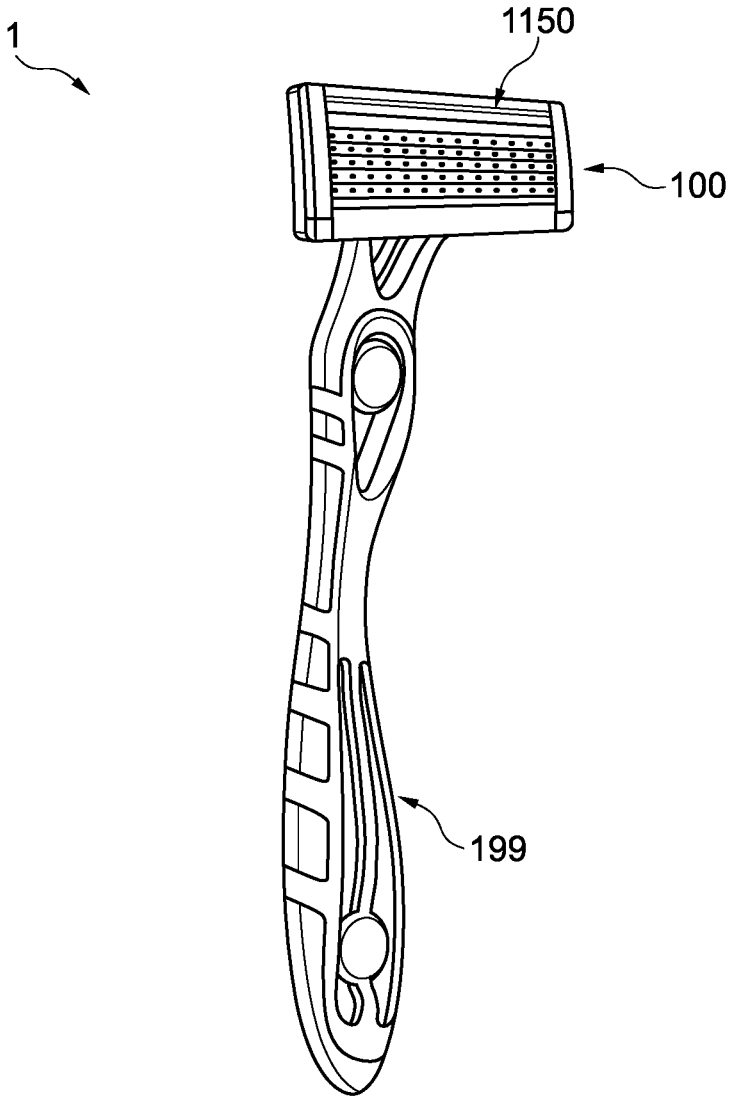
FIG. 5 is another perspective view of a razor having a handle and a shaving cartridge.
Figure 6A:
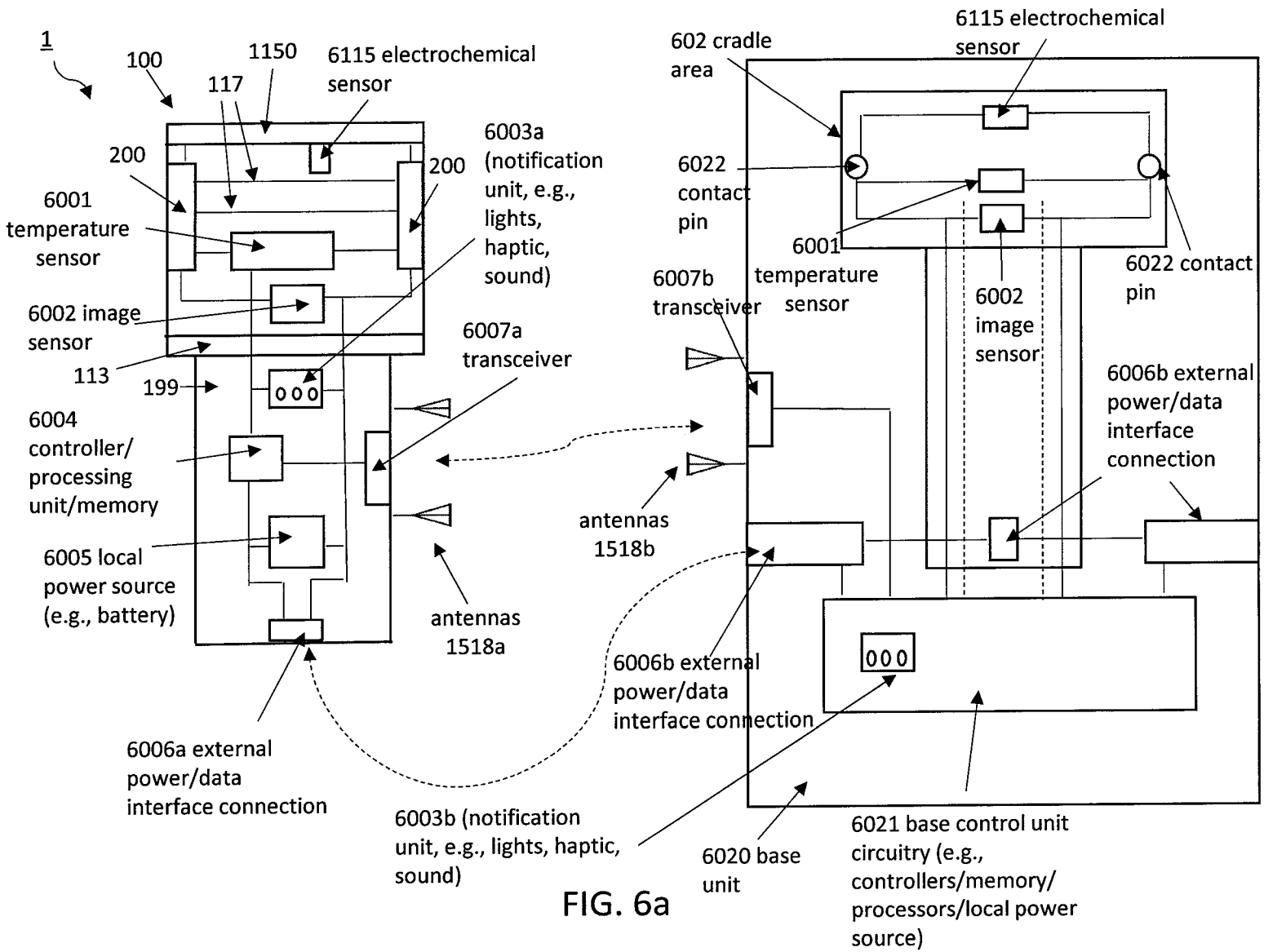
FIG. 6*a* is a schematic showing various electric/electronic components of a razor and an external base module, as well as communication paths between the razor and the base module, according to an embodiment of the present disclosure.
Figure 6B:
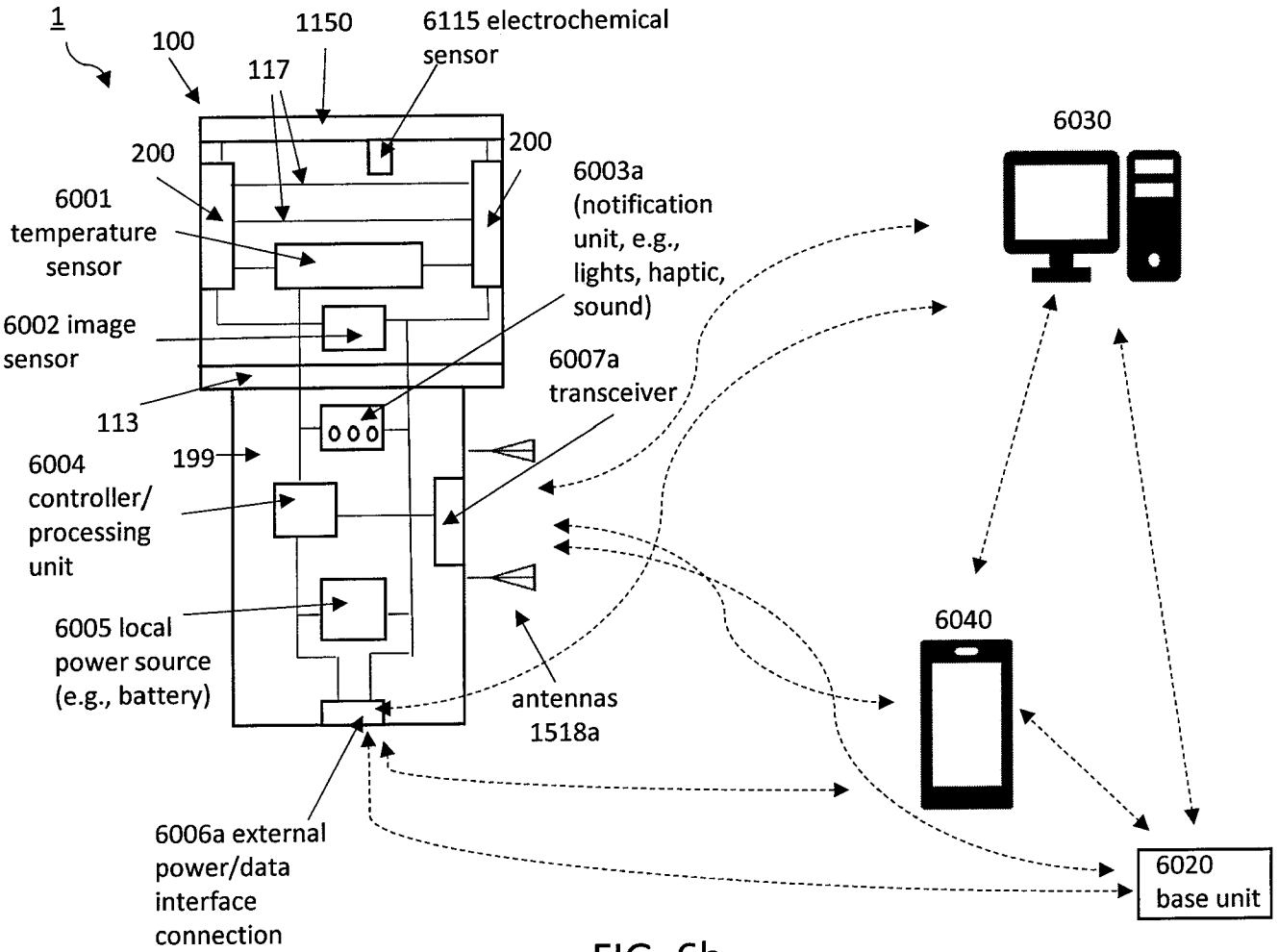
FIG. 6*b* is a schematic showing various electric/electronic components of a razor, as well as communication paths between the razor and external devices, according to another embodiment of the present disclosure.

FIGS. 4-5 show an example razor 1 having a handle 199 and a cartridge 100. In this exemplary embodiment, a smart polymer 1150 designed to selectively generate lubricant, cosmetic and/or other materials is provided on the cartridge. The location of the smart polymer 1150 substantially corresponds to the surface of the cap 115 shown in FIGS. 1-2. According to the present disclosure, systems and methods are provided to advantageously implement at least (i) adaptively releasing lubricants in accordance with changes in the ambient conditions, (ii) determining a level of smart polymer remaining on the shaving cartridge, and (iii) notifying a user when to replace a cartridge that has depleted the smart polymer and/or the lubricant supply. In an example embodiment, various components (including electric and/or electronic components) and circuitry can be provided in or on the razor to implement various aspects of the present disclosure, as shown in FIGS. 6*a* and 6*b*.

"Smart" polymers are artificial materials designed to respond in a particular manner when exposed to at least one environmental stimulus. In many cases, a slight change in environment stimulus is sufficient to induce a large change in the smart polymer's property.

The environmental stimulus can include temperature, pH, humidity/moisture, redox, weight, electrical stimulus, chemical stimulus, light (wavelength and/or intensity), electric/magnetic field, and/or electrochemical stimulus. Some example responses of "smart" polymers include: change in color; change in transparency; change in conductance; change in permeability (e.g., to liquid); and change in shape. Some example applications of the smart polymers include, e.g., delivery and/or absorption systems that adaptively respond to changes in heat, pH, humidity and/or moisture level; self-healing paint that adaptively responds to UV light and/or redox; shape memory materials that adaptively respond to weight and/or electric field; drug delivery systems that adaptively respond to electrochemical stimulus; and materials that adaptively responds to light.

The present disclosure provides systems and methods to determine at least one environmental condition (e.g., temperature and/or pH) of the shaving area of the skin, e.g., temperature of the skin, temperature of the water, temperature of air in the shaving area, and/or pH of the material in the shaving area of the skin, and utilize the determined environmental condition(s) in combination with the smart polymer(s). For example, a smart polymer can respond to a change in temperature, e.g., when the water and/or air temperature becomes cold, by undergoing a physical and/or chemical change to generate or form a lubricant and/or cosmetic material. Conversely, the amount of lubricant generated can be reduced when the water and/or air temperature becomes hot. These examples are not limiting.

In another example, the detected environmental condition can be utilized by a control element (e.g., in the shaver or separate from the shaver) that generates an activation signal to activate a smart polymer to respond to the detected environmental condition. For example, in the case of a smart polymer that responds to electric current, a signal corresponding to a detected change in temperature can be used by a control element to generate an electrical trigger current to the smart polymer to "trigger" the smart polymer. Alternatively, the detected sensor signal can be transmitted to an external control device and/or an app, which in turn sends a trigger signal to the control element to generate the electrical trigger current to be sent to the smart polymer.

In one embodiment, an electrochemical sensor located in or on the shaving cartridge 100, or located in or on a handle to which the cartridge is attached, can be used for determining the level of smart polymer remaining. In addition, other locations and/or sensor arrangements for the smart-polymer level detection can be implemented. For example, the electrochemical sensor can be provided in or on a base unit separate from the shaver. In another example embodiment, an image sensor can be provided to implement the detection of smart polymer. The image sensor can be provided, e.g., (i) in or on the shaving cartridge 100, (ii) in or on a handle to which the cartridge is attached, or (iii) in or on the base unit. For each of these exemplary embodiments, the detected and/or measured level of smart polymer can be stored in a storage element in shaving cartridge 100 or the handle, and/or can be transmitted (e.g., via a wired or wireless connection) to, and/or stored in, the base unit. The embodiments, however, are not limited to these exemplary examples.

FIG. 6*a* illustrates various examples of (i) electric and/or electronic components of a razor 1 (shown on the left side of FIG. 6*a*) having a cartridge 100, a handle 199 and a smart polymer strip 1150, (ii) electric, electrochemical and/or electronic components of an external base module or unit 6020 (shown on the right side of FIG. 6*a*), and (iii) various connection and communication paths between the razor 1 and base module or unit 6020, according to embodiments of the present disclosure.

Razor 1, illustrated in FIG. 6*a*, includes the following exemplary components that are electrically and/or communicatively connected: a temperature sensor 6001; an image sensor 6002, which can be provided in addition to the temperature sensor 6001; an electrochemical sensor 6115, which can be provided in addition to, or alternatively to, to the image sensor 6002 and/or the temperature sensor 6001; a notification unit 6003*a*, which can be configured to generate a visual (e.g., lights), haptic and/or sound notification; a control unit 6004, which can be configured to include a controller, a processing unit and/or a memory; a local power source 6005 (e.g., battery); an interface unit 6006*a*, which can be configured as an interface for external power connection and/or external data connection; a transceiver unit 6007*a* for wireless communication; and antennas 1518*a*.

The temperature sensor 6001 is configured to measure a temperature of the shaving area of the skin, which temperature can be influenced by, e.g., temperature of the skin, temperature of the water, temperature of air in the shaving area and temperature of the shaving aid used. Based on a comparison of the detected temperature to a reference threshold level, the smart polymer can be activated to generate a lubricant, a cosmetic and/or other materials (from the smart polymer itself) and/or release a secondary lubricant held by the smart polymer acting as a holding matrix. Alternatively, in the case of a smart polymer that is responsive to changes in temperature, the smart polymer can be automatically activated based on the change in the temperature of the shaving area of the skin, e.g., when the temperature becomes too cold. Conversely, the smart polymer can automatically reduce or stop the generation of the lubricant, the cosmetic and/or other materials when the temperature becomes hot.

In addition, image sensor 6002 is configured to detect an image of a region of the cartridge 100 on which the smart polymer 1150 is provided. For example, by comparing the detected image to one or more predefined reference thresholds, one or more levels of smart polymer 1150 remaining on the cartridge 100 can be detected. For example, the smart polymer 1150 can be provided over a depletion-indicating layer, which may be (i) a dyed layer having a specified color different from the smart polymer 1150, and/or (ii) a layer having a leachable color that is imparted to the smart polymer 1150. As the smart polymer 1150 is depleted, the color of the depletion-indicating layer will become more prominent in comparison to the color of the smart polymer 1150. By comparing the color of the detected image of the region of the cartridge 100 on which the smart polymer 1150 is provided with the reference color of the depletion-indicating layer, the level of smart polymer 1150 remaining (or the corresponding depletion level of the smart polymer) can be determined.

In addition to, or alternative to, determining the level of smart polymer 1150 remaining based on the detected image, the electrochemical sensor 6115 can be used to detected a property of the smart polymer 1150 present, and in turn determine the level of smart polymer 1150 remaining.

Control unit 6004 receives and processes the information output from the temperature sensor 6001 to control the activation of the smart polymer 1150. The control unit 6004 can compare the detected temperature to a reference temperature level or a reference activation temperature range to determine whether the smart polymer 1150 should be activated to generate the lubricant to aid the shaving process.

For example, in the case of a smart polymer that is responsive (i.e., physically and/or chemically changes) to electrical stimulus, if the detected temperature is below the reference temperature level or in the activation temperature range, the control unit 6004 can generate and send a trigger (or activation) current to the smart polymer 1150 to activate it. For smart polymers that are responsive to other stimulus, e.g., light, electrochemical stimulus, magnetic field, and the like, appropriate trigger stimulus can be provided. These examples are not limiting.

Control unit 6004 can also receive and process the information output from the image sensor 6002 and/or the electrochemical sensor 6115 to determine the level of smart polymer remaining. The control unit 6004 can compare the color (or shade) of the detected image of the region of the cartridge 100 on which the smart polymer 1150 is provided to at least one predefined reference color (or shade), and based on the deviation of the detected color (or shade) to the at least one reference color (or shade), one or more levels of smart polymer 1150 remaining on the cartridge 100 may be detected. For example, a first reference color (or shade) may correspond to a completely "full" condition of the smart polymer 1150. A second reference color (or shade) may correspond to a condition in which 33% of smart polymer 1150 has been depleted. A third reference threshold color (or shade) may correspond to a condition in which 66% of smart polymer 1150 has been depleted. A fourth reference color (or shade) may correspond to a condition in which the smart polymer 1150 is completely depleted. These examples are not limiting.

Alternatively, or in addition, control unit 6004 can compare the output of the electrochemical sensor 6115 to one or more reference thresholds (e.g., representing various specified percentages of a "full" smart polymer 1150) to determine the level of smart polymer 1150 remaining. For example, a first reference threshold level may correspond to a completely "full" condition of the smart polymer 1150. A second reference threshold level may correspond a condition in which 33% of smart polymer 1150 has been depleted. A third reference threshold level may correspond a condition in which 66% of smart polymer 1150 has been depleted. A fourth reference threshold level may correspond to a condition in which the smart polymer 1150 is completely depleted. These examples are not limiting.

Control unit 6004 can provide information regarding the determined level(s) of depletion (or remaining amount/percentage) of the smart polymer 1150 to notification unit 6003*a*, which in turn can generate output signal(s) corresponding to the determined level(s) of depletion (or remaining amount/percentage) by at least one of (i) a light indication (e.g., using different colored LED lights), (ii) an aural indication (e.g., using different sound levels and/or patterns), and/or (iii) a haptic indication (e.g., using different haptic intensity and/or patterns). In an example embodiment, each of these forms of indication can indicate, e.g., three different levels of depletion (or remaining amount/percentage): a first level corresponding to 0-33% depletion (or corresponding remaining amount/percentage); a second level corresponding to 34-66% depletion (or corresponding remaining amount/percentage); and a third level corresponding to 67-100% depletion (or corresponding remaining amount/percentage). In this example embodiment, the indication corresponding to the third level of depletion (or corresponding remaining amount/percentage) can be used as an indication to the user of shaving cartridge 100 to replace the cartridge. In an alternative example embodiment, a single ON/OFF "depleted" indication can be provided, either in addition to, or alternatively to, the above-described three different levels of depletion (or corresponding remaining amount/percentage), using the at least one of the light, aural and haptic indication. In this alternative example, a level corresponding to 80-100% depletion (or corresponding remaining amount/percentage) of the smart polymer 1150 would be indicated by the "depleted" indication being turned ON. These examples are not limiting.

Control unit 6004 can cumulatively collect and/or store the information regarding the determined level of depletion (or corresponding remaining amount/percentage) to analyze and/or determine the rate of smart polymer depletion. In addition, control unit 6004 can analyze the rate of smart polymer depletion in conjunction with data provided by a user or data from a database regarding particular skin characteristics and/or hair properties, thereby enabling customized analysis and data collection of an individual user's razor use.

The information output from temperature sensor 6001, image sensor 6002, electrochemical sensor 6115 and/or the information regarding the determined level of depletion (or corresponding remaining amount/percentage), can be transmitted (i) wirelessly via the transceiver 6007*a* or (ii) via a wired connection through interface unit 6006*a* for external power/data connection, to base module or unit 6020 which is external to razor 1. As shown in FIG. 6*a*, base module or unit 6020 includes, for example, the following components: base control unit circuitry 6021, which can include controller(s), memory, processors, an app, and a local power source (e.g., battery); a temperature sensor 6001 in a cradle area 602 and, either alternatively to or in addition to sensor 6001, an image sensor 6002 and/or electrochemical sensor 6115 in cradle area 602; two contact pins 6022 in cradle area 602; a notification unit 6003*b*, which can be configured to generate a visual (e.g., three different colored LED lights corresponding to different levels of depletion of the smart polymer 1150, as described above), haptic and/or sound notification; one or more interface unit(s) 6006*b*, which can be configured as an interface for external power connection and/or external data connection; a transceiver unit 6007*b* for wireless communication; and antennas 1518*b*.

Base module or unit 6020 can be used in conjunction with razor 1 in multiple ways. In a first example, information received (e.g., via a hard-wired connection through interface 6006*b* or wirelessly via transceiver 6007*b*) from razor 1 (e.g., information output from temperature sensor 6001, image sensor 6002, electrochemical sensor 6115 and/or the information regarding the determined level of depletion of smart polymer 1150) can be used, e.g., by base control unit circuitry 6021, to indicate the determined level of depletion of the smart polymer 1150 by an output via notification unit 6003*b*.

In a second example, information received (e.g., via a hard-wired connection through interface 6006*b* or wirelessly via transceiver 6007*b*) from razor 1 (e.g., information output from temperature sensor 6001, image sensor 6002, electrochemical sensor 6115 and/or the information regarding the determined level of depletion of smart polymer 1150) can be cumulatively collected, stored, and/or analyzed by base control unit circuitry 6021 of base module or unit 6020 to determine the rate of depletion of the smart polymer 1150. In addition, base control unit circuitry 6021 of base module or unit 6020 can analyze the rate of smart polymer depletion in conjunction with data provided by a user or data from a database regarding particular skin characteristics and/or hair properties, thereby enabling customized analysis and/or data collection of an individual user's razor use.

In a third example, the information output from temperature sensor 6001, image sensor 6002, and/or electrochemical sensor 6115 can be transmitted (i) wirelessly via the transceiver 6007*a* or (ii) via a wired connection through interface unit 6006*a* for external power/data connection, to the base control unit circuitry 6021 of the base module or unit 6020. The base control unit circuitry 6021 can perform the functions/operations performed by the control unit 6004 as described above, e.g., (i) compare the detected temperature to a reference threshold level to determine whether the smart polymer 1150 is to be activated to generate a lubricant, and/or (ii) determine the depletion level (or corresponding remaining amount/percentage) of the smart polymer 1150. If it is determined that the smart polymer 1150 is to be activated, the base control unit circuitry 6021 can send a trigger signal, either wirelessly via the transceiver 6007*b* or via a wired connection through interface unit 6006*b*, to the control unit 6004, which in turn can generate and send a trigger (or activation) stimulus, e.g., current, to the smart polymer 1150 to activate it.

In a fourth example, base module or unit 6020 can be used to make the temperature detection, the image detection and/or the electrochemical detection directly, instead of the temperature detection, the image detection and/or the electrochemical detection being performed by the components of razor 1. For the direct measurement by base module or unit 6020, shaving cartridge 100 is placed in cradle area 602 of base module or unit 6020. In one example embodiment, retainers 200 of shaving cartridge 100 can be placed in electrical contact with contact pins 6022 of base unit or module 6020, thereby enabling detection of the presence of shaving cartridge 100 in cradle 602. Temperature sensor 6001, image sensor 6002 and the electrochemical sensor 6115 of the base module or unit 6020 can perform substantially identical functions as the temperature sensor 6001, image sensor 6002 and the electrochemical sensor 6115 provided in the razor 1, respectively. Base control unit circuitry 6021 can process and compare the temperature sensor output, the electrochemical sensor output and/or the image sensor output to the specified reference threshold level(s) to determine (i) whether the smart polymer 1150 is to be activated, and/or (ii) the level of depletion of the smart polymer 1150. The determined level of depletion of the smart polymer 1150 can be indicated by an output via notification unit 6003*b*, as discussed above in connection with the corresponding processing performed in razor 1.

FIG. 6*b* illustrates alternate embodiments of external devices that can be used instead of, or in conjunction with, base unit or module 6020. In one example, information from razor 1 (e.g., information output from temperature sensor 6001, image sensor 6002, electrochemical sensor 6115 and/or the information regarding the determined level of depletion of smart polymer 1150) can be transmitted, e.g., via a hard-wired connection through interface 6006*a* or wirelessly via transceiver 6007*a*, to a mobile device 6040, which can be provided with clients (e.g., one or more application software or "app") that perform some or all of the functionalities performed by base unit or module 6020 shown in FIG. 6*a*, as well as additional functionalities, e.g., further analysis and/or added service such as automated ordering of replacement cartridges via the Internet. In another example, information from razor 1 (e.g., information output from temperature sensor 6001, image sensor 6002, electrochemical sensor 6115 and/or the information regarding the determined level of depletion of smart polymer 1150) can be transmitted, e.g., via a hard-wired connection through interface 6006*a* or wirelessly via transceiver 6007*a*, to a computer 6030, which can be provided with clients (e.g., one or more application software) that perform some or all of the functionalities performed by base unit or module 6020 shown in FIG. 6*a*, as well as additional functionalities, e.g., further analysis and/or added service such as automated ordering of replacement cartridges via the Internet. In another example, information and/or processing of information can be shared among razor 1, base unit or module 6020, computer 6030, and mobile device 6040.

Figure 6C:
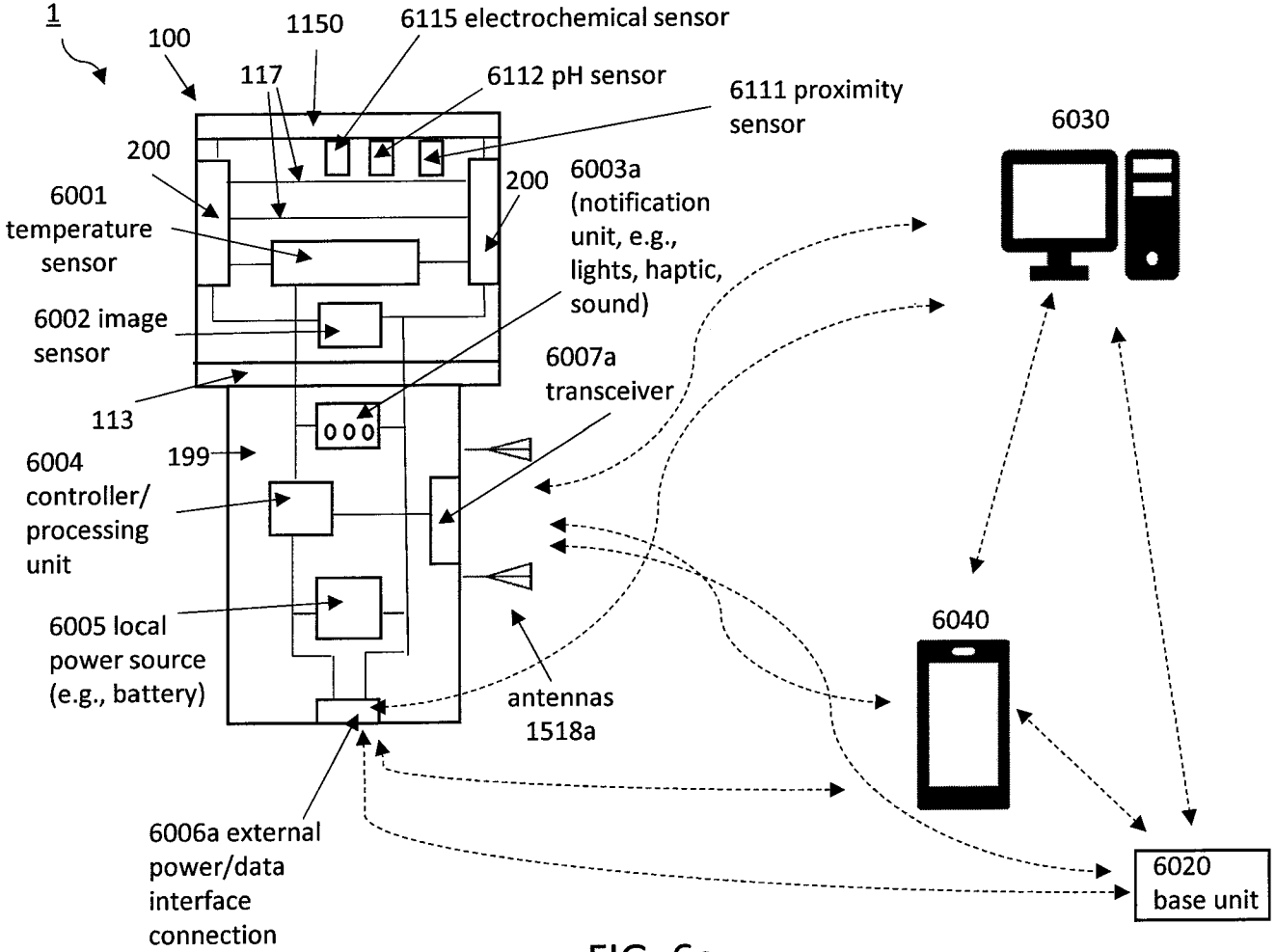
FIG. 6*c* is a schematic showing various electric/electronic components of a razor, as well as communication paths between the razor and external devices, according to still another embodiment of the present disclosure.

FIG. 6*c* shows an example embodiment of a shaver 1 which includes a proximity sensor 6111 and a pH sensor 6112. Although the pH sensor 6112 is shown separately from the electrochemical sensor 6115, the pH sensor 6112 may be a part of the electrochemical sensor 6115, i.e., the electrochemical sensor 6115 may be configured to provide the functionalities of the pH sensor 6112 described below. In addition, or as an alternative to the sensors 6111 and 6112, shaver 1 may include a light sensor. Proximity sensor 6111 may be configured to determine whether shaver 1 is actively being used by a user to shave skin, or whether it is, for example, being cleaned. More specifically, proximity sensor 6111 may be configured to indicate whether cartridge 100 is in contact with a user's skin or whether cartridge 100 is not in contact with a user's skin. pH sensor 6112 may be configured to detect a pH value of the user's skin or a substance (e.g., shaving cream, shaving gel, or water) contacting a face of cartridge 100. Sensors 6111 and 6112 may be located on a surface of cartridge 100 configured to contact a user's skin (e.g., retainer 200, cap 115, etc.), or alternatively, the sensors 6111 and 6112 may be provided in areas of the shaver 1 which do not directly contact the skin. Sensors 6111 and 6112 may be disposed in any suitable position and/or configuration on or in cartridge 100, as described below in greater detail. Though only one sensor 6111 and sensor 6112 are depicted in FIG. 6*c*, those of ordinary skill in the art will readily recognize that any suitable number of sensors 6111 and 6112 may be provided. In some embodiments, only one of sensors 6111 and 6112 may be provided.

In one example, proximity sensor 6111 may emit an electromagnetic or electrostatic field, or a beam of electromagnetic radiation (e.g., infrared), and look for changes in the field or return signal. In other embodiments, proximity sensor 6111 may detect a force being applied against cartridge 100 via a load cell, piezoelectric sensor, strain gauge, or any other suitable mechanism. Other examples of proximity sensors include capacitive sensors, resistive sensors, inductive sensors, photo sensors, electromagnetic field sensors, capacitive displacement sensors, eddy-current, magnetic, photocell (reflective), laser, passive thermal infrared, passive optical, charge-coupled devices, reflection of ionizing radiation, and any combinations thereof.

Proximity sensor 6111 may be integrated into any part of shaver 1. For example, proximity sensor 6111 may be in cartridge 100. In other embodiments, proximity sensor 6111 may be in handle 199 of shaver 1. When there are multiple proximity sensors 6111, different proximity sensors 6111 may be integrated into the same part (e.g., cartridge 100) of shaver 1. Alternatively, proximity sensors 6111 may be integrated into different parts of shaver 1. For example, both cartridge 100 and handle 199 may contain proximity sensors 6111.

As set forth above, pH sensor 6112 may detect the pH value of a user's skin and/or of any other substance that comes into contact with cartridge 100. pH sensor 6112 may include a glass electrode and a reference electrode. The glass electrode may include a doped glass membrane sensitive to a specific ion, e.g., hydrogen ions. In some embodiments, the glass electrode may include a silicate matrix based molecular network of silicon dioxide ($SiO_2$) with additions of other metal oxides, such as Na (sodium), K (potassium), Li (lithium), Al (aluminum), B (boron), and Ca (calcium). In certain embodiments, the glass electrode may include a chalcogenide matrix based on molecular network of AaS (arsenic-sulfur), AsSe (arsenic-selenium), and AsTe (arsenic-tellurium). The reference electrode may be insensitive to the pH of the tested solution and have a stable and known electrode potential.

The superficial layers of the skin are naturally acidic (pH 4-4.5) due to lactic acid in sweat and produced by skin bacteria. At this pH, mutualistic flora such as Staphylococci, Micrococci, *Corynebacterium* and *Propionibacteria* may grow but not transient bacteria such as Gram-negative bacteria like *Escherichia* and *Pseudomonas* or Gram-positive ones such as *Staphylococcus aureus*. Another factor affecting the growth of pathological bacteria is that the antimicrobial substances secreted by the skin are enhanced in acidic conditions. In alkaline conditions, for example, when skin pH is 9 or above, bacteria cease to be attached to the skin and are more readily shed. It has been observed that the skin also swells under alkaline conditions and opens up, thereby increasing the risk of infection.

Shaver 1 may include any number of proximity sensors 6111 and pH sensors 6112. In some embodiments, shaver 1 may include only one proximity sensor and one pH sensor 6112. In other embodiments, shaver 1 may include two, three, four, five, six, or more proximity sensors 6111 and pH sensors 6112. The sensors may be disposed on a skin-contacting surface (e.g., retainer 200, cap 115, etc.) of cartridge 100 and may be spaced about a periphery of cartridge 100. For example, sensors 6111 and 6112 may be disposed on opposing sides of cartridge 100. However, in other embodiments, one or more of the sensors may be disposed on a non-skin-contacting surface of shaver 1.

Data captured by sensors 6111 and 6112 may be stored in a memory and/or analyzed by a processing unit as described in connection with the embodiments shown in FIGS. 6*a* and 6*b*, e.g., using control unit 6004, base control unit circuitry 6021, computer 6030 and/or mobile device 6040. In exemplary embodiments, data from sensors 6111 and 6112 may be analyzed to determine whether the user's skin is adequately lubricated during shaving, and/or whether the user would benefit from one or more specialized items to optimize shaving performance and comfort, e.g., release of a lubricant and/or a cosmetic. The components of the shaving system also may be configured to receive data transmitted from the processing unit (e.g., control unit 6004, base control unit circuitry 6021, computer 6030 and/or mobile device 6040).

As set forth above, the processing unit (e.g., control unit 6004, base control unit circuitry 6021, computer 6030 and/or mobile device 6040) may determine whether shaver 1 is being actively used to shave the user's skin 900 (FIG. 2), or whether shaver 1 is being cleaned, e.g., by water 901 (FIG. 3) or another suitable cleaning solution. When the user is shaving, pH sensor 6112 may be configured to measure a pH of the user's skin, and/or of a substance thereon (e.g., sebum or shaving agents). For example, at various times while shaving, pH sensor 6112 may come into contact with a shaving agent such as shaving cream, shaving soap, shaving gel, shaving foam, and/or shaving oil. At other times while shaving, pH sensor 6112 may not be in contact with any shaving agent, and instead may be in contact with only the user's skin and the oils or liquid otherwise present on the skin. More particularly, in aspects where shaver 1 includes a plurality of sensors, including, but not limited to, a pH sensor 6112 and a light sensor, information from the light sensor may assist the processing unit (e.g., control unit 6004, base control unit circuitry 6021, computer 6030 and/or mobile device 6040) in determining whether shaver 1 is in contact with the user's skin or a shaving agent. For example, if the light sensor detects that the area being shaved is relatively "white" or of a lighter color tone, the processing unit (e.g., control unit 6004, base control unit circuitry 6021, computer 6030 and/or mobile device 6040) may determine that shaver 1 is in contact with a shaving agent, and the pH information measured by pH sensor 6112 relates to that of the shaving agent. If, however, the light sensor detects that the area being shaved is relatively "dark" or of a darker color tone, the processing unit (e.g., control unit 6004, base control unit circuitry 6021, computer 6030 and/or mobile device 6040) may determine that shaver 1 is in contact with the user's skin, and the pH information measured by pH sensor 6112 relates to that of the user's skin. In some aspects, a user also may be prompted to input skin color, tone, or type information into an application (e.g., a mobile application accessed via a smartphone) associated with shaver 1 or the separate base described above. As a result, the processing unit (e.g., control unit 6004, base control unit circuitry 6021, computer 6030 and/or mobile device 6040) may be more readily able to discern between a user's skin and shaving agent based on information from a light sensor associated with shaver 1.

When the processing unit (e.g., control unit 6004, base control unit circuitry 6021, computer 6030 and/or mobile device 6040) interprets data from proximity sensor 6111 as indicating that cartridge 100 is in contact with a user's skin (e.g., during a shaving session), the processing unit (e.g., control unit 6004, base control unit circuitry 6021, computer 6030 and/or mobile device 6040) may designate the values concurrently detected by pH sensor 6112 as "skin pH values" (e.g., pH values of the user's skin) and/or as "active shaving pH values." The processing unit (e.g., control unit 6004, base control unit circuitry 6021, computer 6030 and/or mobile device 6040) may determine that shaver 1 is being actively used to shave the user's skin, for example, when a measured force by proximity sensor 6111 is greater than a threshold value, and also when the measured force is substantially similar to a force profile indicative of a shaving stroke. That is, the processing unit (e.g., control unit 6004, base control unit circuitry 6021, computer 6030 and/or mobile device 6040) may be configured to prevent itself from recording pH measurements when a force is applied to shaver 1 outside the context of a shaving procedure on skin. The processing unit (e.g., control unit 6004, base control unit circuitry 6021, computer 6030 and/or mobile device 6040) may designate both (and differentiate between) skin pH values and active shaving pH values because, while shaver 1 is actively being used to shave the user's skin, the presence of a shaving agent may alter the pH values measured by pH sensor 6112. In some embodiments, the processing unit (e.g., control unit 6004, base control unit circuitry 6021, computer 6030 and/or mobile device 6040) may designate pH measurements from pH sensor 6112 as "shaving agent pH values."

The processing unit (e.g., control unit 6004, base control unit circuitry 6021, computer 6030 and/or mobile device 6040) may compare the pH value of a user's skin detected by pH sensor 6112 to a reference pH value or range for skin pH (e.g., about 4 to about 5.5) to determine a hydration level and/or health condition of the user's skin. If the detected pH is different from the optimal value or out of the optimal range, then the processing unit (e.g., control unit 6004, base control unit circuitry 6021, computer 6030 and/or mobile device 6040) may generate an alert indicating that shaver 1 is not functioning properly or that additional or different lubrication should be used, and/or that shaver 1 may be causing damage to the skin. Skin pH values above or below this optimum range may indicate dry and/or sensitive skin. The processing unit (e.g., control unit 6004, base control unit circuitry 6021, computer 6030 and/or mobile device 6040) also may suggest a replacement of shaver 1, cartridge 100, and/or lubricants are needed. In yet further embodiments, the processing unit (e.g., control unit 6004, base control unit circuitry 6021, computer 6030 and/or mobile device 6040) may order the replacement parts so that they are sent to a physical address of the user. In such embodiments, the processing unit (e.g., control unit 6004, base control unit circuitry 6021, computer 6030 and/or mobile device 6040) may be configured to transmit an order to a merchant via, e.g., a connection to the internet. If the measured pH of the user's skin is within the optimum range, the processing unit (e.g., control unit 6004, base control unit circuitry 6021, computer 6030 and/or mobile device 6040) may record such data and inform the user that his or her skin pH is in a healthy and optimal range, and/or that no changes are necessary to the user's shaving regimen or practice.

In use, for example, if the processing unit (e.g., control unit 6004, base control unit circuitry 6021, computer 6030 and/or mobile device 6040) determines that the user's skin pH is below, e.g., about 4.5, the processing unit (e.g., control unit 6004, base control unit circuitry 6021, computer 6030 and/or mobile device 6040) may prevent razor 1 from releasing any lubricants so as to maintain the user's skin in a relatively more "acidic" condition, which, as explained above, may promote retention of the skin's natural bacterial flora and may prevent growth of pathological bacteria. If, however, the processing unit (e.g., control unit 6004, base control unit circuitry 6021, computer 6030 and/or mobile device 6040) determines that the user's skin pH is above, e.g., about 8, lubricants may be released to lower the user's skin pH to a relatively normal pH range of approximately 5. In the aforementioned example, it is contemplated that the pH of the lubricants used with shaver 1 may be above, e.g., about 4.5 or normal skin pH.

In yet other embodiments, the processing unit (e.g., control unit 6004, base control unit circuitry 6021, computer 6030 and/or mobile device 6040) may control the amount of lubricant (e.g., shaving cream, gel, or lotion) released from a reservoir in shaver 1 based on the pH values measured by pH sensor 6112 when the user is shaving. As indicated above, measurements from proximity sensor 6111 may be used to help determine that the user is shaving. Additionally, the user may inform the processing unit (e.g., control unit 6004, base control unit circuitry 6021, computer 6030 and/or mobile device 6040) that shaver 1 is being used for shaving by activating a switch on shaver 1 and/or by inputting data into, e.g., a mobile application associated with shaver 1. In other examples, the processing unit (e.g., control unit 6004, base control unit circuitry 6021, computer 6030 and/or mobile device 6040) may generate an alert that shaver 1 is being used to shave an irritated area, and that further usage of shaver 1 in that area may exacerbate the irritation. This alert, which could be an audio alert, could signal to a user to manually apply additional lubrication. Skin irritation may be detected by, e.g., a temperature sensor included in the cartridge 100. An increase in skin temperature may be indicative of skin irritation. The present disclosure contemplates any suitable method of detecting skin irritation now known or developed in the future. In another embodiment, skin irritation may be detected by, e.g., an optical sensor configured to detect skin redness caused by an accumulation of blood under the skin. An increase in skin redness may be indicative of skin irritation.

Shaver 1 also may include a dedicated pH measurement mode where proximity sensor 6111 and pH sensor 6112 can be used in conjunction with one another to determine skin pH. For example, the user may signal to the processing unit (e.g., control unit 6004, base control unit circuitry 6021, computer 6030 and/or mobile device 6040) a desire to measure skin pH. This could be performed at any time, for example, before, during, or after shaving. After providing such a signal to the processing unit (e.g., control unit 6004, base control unit circuitry 6021, computer 6030 and/or mobile device 6040), shaver 1, and in particular, the face of cartridge 100 may be placed into contact with the user's skin and the processing unit (e.g., control unit 6004, base control unit circuitry 6021, computer 6030 and/or mobile device 6040) may correlate the measured data to skin pH. During data collection, the user may simultaneously, or substantially simultaneously, inform the processing unit (e.g., control unit 6004, base control unit circuitry 6021, computer 6030 and/or mobile device 6040) of the area of the body that is being measured (e.g., the face, a specific part of the face, the leg, the armpit), for more specific data collection and analysis.

Other mechanisms also may be used to notify a user that the skin is becoming irritated and in need of additional lubrication. For example, a user may open an application on a computer or smartphone prior to commencement of shaving. As the user shaves, information about the shaving session may be generated and analyzed, and the results of the analysis may be displayed to the user via the application. For example, a picture of a face may appear on the application, and areas of the face may be indicated to the user as requiring more shaving or as being sufficiently shaved. Charts, text, colors, lights, pictures, or other suitable visual aids may indicate where the user does and does not need to shave, the percentage of shaving left or accomplished in a given area, or other suitable feedback. In some embodiments, the application may provide auditory or tactile feedback instead of, or in addition to, visual feedback; for example, a vibration or sound may indicate that a region of the body has been adequately shaved. In some embodiments, a voice may direct the user as to which portions of the user's face are becoming irritated. In such embodiments, shaver 1 may be coupled to the application via any suitable wired or wireless interface.

In some embodiments, lights, noises, vibrations, and/or other visual, tactile, or auditory feedback may be provided on a separate base. For example, a light may go on when an area is becoming irritated (as determined by a skin pH out of the optimal range), or a light may turn from green to red to indicate whether to apply additional lubrication to the face. Alternatively, a screen on the base may show similar visual indicators as those described above in reference to the application, or a vibration or sound may be generated by the base as described above.

In some embodiments, the feedback described above may be incorporated into shaver 1. For example, shaver 1 may vibrate or emit a sound when a body region is sufficiently lubricated, and/or lights may indicate the sufficiency of lubrication for a given area, and/or a screen may indicate whether or not an area needs to be further lubricated, e.g., by providing a percentage level or other suitable indication.

In this way, using shaver 1 may provide a user with real-time feedback regarding skin irritation and/or lubrication levels. This guidance and feedback may help to guide a shaving session so that irritated portions of the body region are not further exacerbated and/or to prevent or minimize irritation.

It is also contemplated that other feedback may be provided to the user. For example, shaving tips may be sent to the user, such as types of lubrication, type of shaver 1 or cartridge 100, and the like, that may provide more desirable results for a particular user. This information may help to optimize the user's shaving experience and to provide the user with a more enjoyable shaving experience.

When the processing unit (e.g., control unit 6004, base control unit circuitry 6021, computer 6030 and/or mobile device 6040) determines, based on data from proximity sensor 6111 or input from the user, shaver 1 is not actively being used to shave the user's skin, the processing unit (e.g., control unit 6004, base control unit circuitry 6021, computer 6030 and/or mobile device 6040) may designate pH values measured by pH sensor 6112 as "non-shaving pH values." In some embodiments, the processing unit (e.g., control unit 6004, base control unit circuitry 6021, computer 6030 and/or mobile device 6040) may attribute non-shaving pH values to the pH of tap water used to clean and rinse shaver 1 during and after use. For example, non-shaving pH values may be collected when shaver 1 is rinsed by water from a faucet (e.g., FIG. 3), or being rinsed in a bowl of water.

In certain embodiments, the processing unit (e.g., control unit 6004, base control unit circuitry 6021, computer 6030 and/or mobile device 6040) may provide one or more recommendations to a user based on the pH value of the tap water. Typically, tap water may range from relatively acidic (e.g., having a pH of less than or equal to about 6.5), relatively basic (e.g., having a pH between about 6.5 and 8.5), or relatively hard (e.g., having a pH of 8.5 or more). For example, if the determined pH of the water is outside of a normal pH range, e.g., about 6.5 to about 8.5, the processing unit (e.g., control unit 6004, base control unit circuitry 6021, computer 6030 and/or mobile device 6040) may suggest a different type of cartridge 100, blades 117, and/or lubricants to protect a user's skin. In some aspects, the processing unit (e.g., control unit 6004, base control unit circuitry 6021, computer 6030 and/or mobile device 6040) may suggests differing cartridges with differing types and quantities of lubricants. The processing unit (e.g., control unit 6004, base control unit circuitry 6021, computer 6030 and/or mobile device 6040) also may order the suggested shaving products to accommodate the water quality detected by the processing unit (e.g., control unit 6004, base control unit circuitry 6021, computer 6030 and/or mobile device 6040) and pH sensor 6112. As discussed above, the processing unit (e.g., control unit 6004, base control unit circuitry 6021, computer 6030 and/or mobile device 6040) may be in communication with the Internet, and may be configured to automatically place an order with an e-commerce merchant without user intervention or input. In alternative embodiments, the processing unit (e.g., control unit 6004, base control unit circuitry 6021, computer 6030 and/or mobile device 6040) may prompt or otherwise suggest an order for suggested shaving products to the user and be configured to receive user input, e.g., confirmation or declination of the order.

The tap water used to clean shaver 1 also may be indicative of the water that the user uses to shower, bathe, and the like. The pH of water used during such activities may have an effect on the user's hair, and the processing unit (e.g., control unit 6004, base control unit circuitry 6021, computer 6030 and/or mobile device 6040) may suggest specific types of lubricants, shavers, blades, and other shaving materials that may improve shaving performance when the user is shaving. For example, when pH sensor 6112 detects that the water pH value is in a certain range, the processing unit (e.g., control unit 6004, base control unit circuitry 6021, computer 6030 and/or mobile device 6040) may suggest a shaver with blades including a protective coating that protects the user's skin under the particular pH condition. Examples of blade coatings that may protect blades 117 include hard carbon coatings (such as diamond, amorphous diamond, diamond-like carbon (DLC)), nitrides, carbides, oxides or ceramics, polytetrafluoroethylene (PTFE) outer layer, interlayers of niobium or chromium containing materials.

In some embodiments, one or more parts of shaver 1 described herein may include smart polymers that may be used to dynamically customize the characteristics of shaver 1. For example, pH-responsive and/or temperature-responsive polymers may be used to control the amount of lubricant released to a user's skin from, e.g., a reservoir during shaving (e.g., based on the skin pH value detected by a pH sensor). In some embodiments, a lubricant may include one or more ingredients containing smart polymers. Such smart polymers may become more lubricious in response to a different pH or temperature (e.g., higher or lower than a baseline pH or temperature).

In one embodiment, the smart polymers may be incorporated into a coating on one or more of blades 117 and cartridge 100, or may be a plug of material coupled to blades 117 or cartridge 100. The smart polymers may be positioned around a periphery of cartridge 100 or a portion thereof, and may be coupled to a non-skin-contacting surface of cartridge 100 or of blades 117. The smart polymers may be incorporated into microparticles or nanoparticles dispersed throughout cartridge 100. In other embodiments, shaver 1 may include a lubricant cartridge containing smart polymers. The smart polymers may change their shape, conformation, and/or hydrophobicity to control the capacity or volume of the cartridge, thus controlling the release of lubricant from the cartridge. Such a lubricant cartridge may be controlled by the processing unit (e.g., control unit 6004, base control unit circuitry 6021, computer 6030 and/or mobile device 6040). For example, the processing unit (e.g., control unit 6004, base control unit circuitry 6021, computer 6030 and/or mobile device 6040) may control the features of the smart polymers by selectively applying stimulus (e.g., relatively small amounts of electrical current) to the smart polymers based on detected pH values. Alternatively or additionally, the smart polymers may respond directly a high pH or temperature (e.g., body temperature).

One or more parts of shaver 1 or one or more ingredients of the shaving agent or lubricants discussed herein may include smart polymers. As used herein, the term "smart polymer" or "stimuli-responsive polymer" may refer to high-performance polymers that change their properties in response to the environment they are in. Stimuli-responsive polymers may be sensitive to various factors, such as temperature, humidity, ion strength, salinity, pH, redox status, force, pressure (e.g., weight), electrochemical stimuli, the wavelength or intensity of light, intensity of an electrical or magnetic field. In response to the factors, stimuli-responsive polymers may change one or more properties such as hydrophobicity, lubricity, color, transparency, conductance, permeability to water, shape, hardness, conformation, adhesiveness, or water retention. In some embodiments, slight changes in the environment may be sufficient to induce large changes in the polymers' properties. For example, in response to a pH indicative of poorly lubricated and/or irritated skin, the processing unit (e.g., control unit 6004, base control unit circuitry 6021, computer 6030 and/or mobile device 6040) may apply a stimulus to a smart polymer to increase the lubricity of the smart polymer. In addition, or alternatively, the lubricity of the smart polymer may be increased without a stimulus from the processing unit (e.g., control unit 6004, base control unit circuitry 6021, computer 6030 and/or mobile device 6040). Instead, exposure to body temperature, pH values associated with skin, water, and/or certain shaving agents may stimulate the smart polymer.

Smart polymers may be used to controllably and/or selectively release a substance (e.g., a lubricant, shaving agent, or skin treatment agent) to the user's skin. For example, the substance may be stored in a cartridge including smart polymers. Such smart polymers may change their shape, conformation, volume, or hydrophobicity and thus adjust the capacity or volume of the cartridge and the amount of the substance released from the cartridge. Alternatively or additionally, the lubricant, shaving agent, or skin treatment agent may include one or more ingredients containing smart polymers. The smart polymers may change their lubricity to make the lubricant, shaving agent, or skin treatment more lubricious and/or easier to release. In another embodiment, the smart polymers may form a valve (or barrier) on cartridge 100, and upon detection of irritated skin based upon a pH value from sensor 6112 or based on smart polymer itself, the valve may open to release lubricant (e.g., stored within a reservoir in or on cartridge 100), or the smart polymer itself may transform into a more lubricious state.

Thus, the smart polymers may change their features directly in response to a sensed characteristic (e.g., pH, hydration level, or temperature) of the user's skin, or the properties of the smart polymer may be adjusted by the processing unit (e.g., control unit 6004, base control unit circuitry 6021, computer 6030 and/or mobile device 6040), e.g., based on a pH level detected by pH sensor 6112. For example, when the sensor 6112 detects that the skin pH is higher or lower than the optimal range, the processing unit (e.g., control unit 6004, base control unit circuitry 6021, computer 6030 and/or mobile device 6040) may adjust the shape, conformation, volume, or hydrophobicity of the smart polymer to release more lubricant to the skin by applying a stimulus to the smart polymer. The processing unit (e.g., control unit 6004, base control unit circuitry 6021, computer 6030 and/or mobile device 6040) may apply any suitable stimulus, including, e.g., a temperature change, applying a light, applying an electric field, applying a small electric charge, or applying any other suitable stimulus to alter the smart polymer accordingly.

The smart polymers used herein may be pH-responsive polymers. Such polymers may change their properties in response to the pH of the user's skin, shaving agent, or water. In addition, or alternatively, the smart polymers used herein may be temperature-responsive polymers. Temperature-responsive polymers may be reversibly self-associative in response to temperature. The smart polymers also may include graft and block copolymers of pH- and temperature-sensitive monomers. Such polymers may retain both pH and temperature transitions independently.

Other suitable smart materials include humidity or water sensitive materials (e.g., delivery systems and absorption systems), redox sensitive materials (e.g., self-healing paints to protect metallic objects from corrosion), weight sensitive materials (e.g., shape memory pillows and mattresses), electrochemical sensitive materials (e.g., drug delivery systems), light sensitive materials (e.g., smart windows to block heat), and electric field sensitive materials (e.g., shape memory alloys for dental seals). Still further examples include PEG (polyethylene glycol, stealth shielding), Pluronics, dendrimers, and cyclodextrin.

Figure 7:
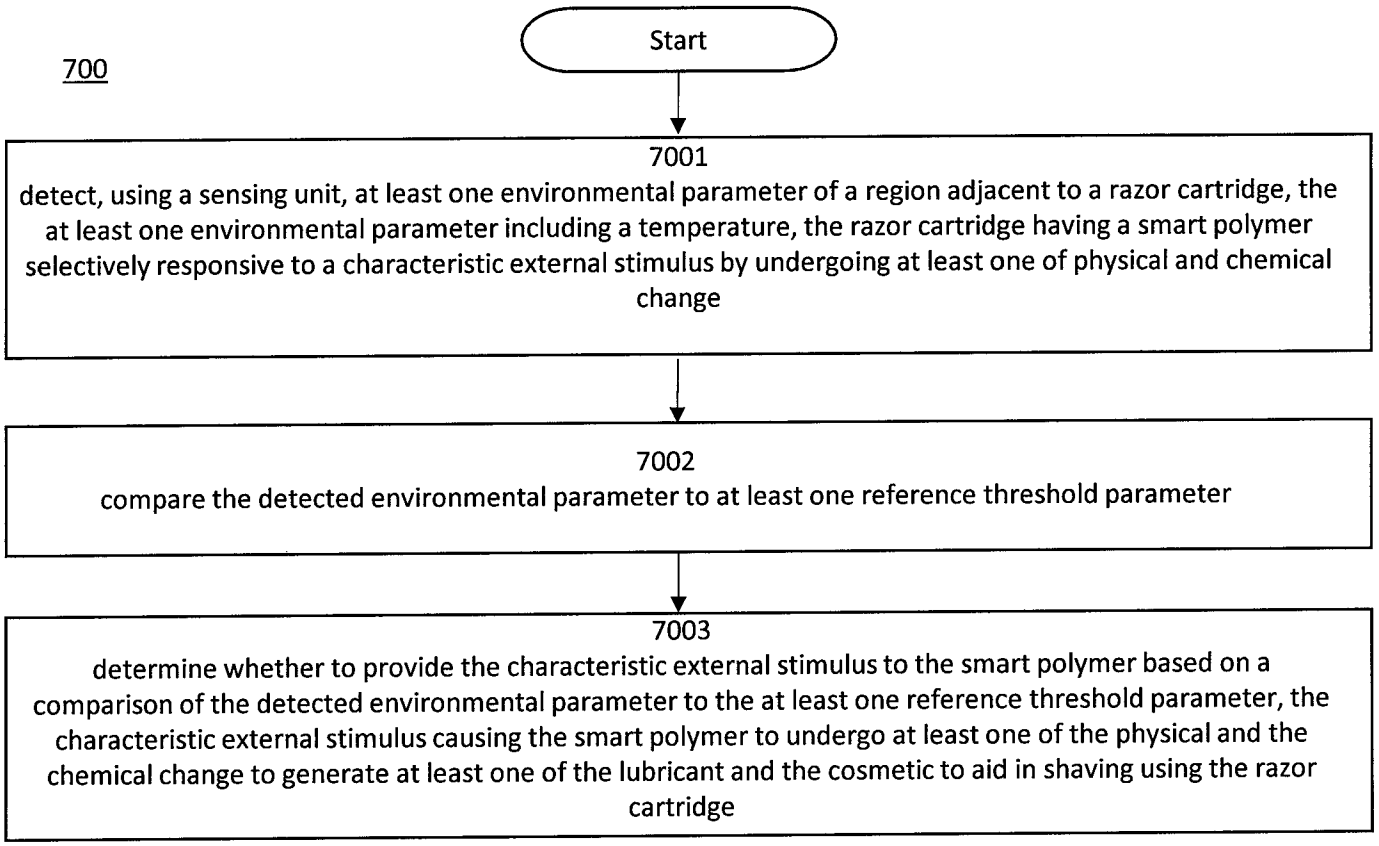
FIG. 7 is a logic flow chart of a method according to an example embodiment.

FIG. 7 illustrates a logic flow 700 of a method for adaptively releasing at least one of a lubricant and a cosmetic for a razor cartridge according to an embodiment. At block 7001, at least one environmental parameter of a region adjacent to a razor cartridge is detected using a sensing unit (e.g., temperature sensor 6001). The at least one environmental parameter includes a temperature, the razor cartridge having a smart polymer selectively responsive to a characteristic external stimulus by undergoing at least one of physical and chemical change. At block 7002, the detected environmental parameter is compared to at least one reference threshold parameter, e.g., by control unit 6004, base control unit circuitry 6021, computer 6030 and/or mobile device 6040. At block 7003, it is determined, e.g., by control unit 6004 and/or base control unit circuitry 6021, whether to provide the characteristic external stimulus to the smart polymer based on a comparison of the detected environmental parameter to the at least one reference threshold parameter, the characteristic external stimulus causing the smart polymer to undergo at least one of the physical and the chemical change to generate at least one of the lubricant and the cosmetic to aid in shaving using the razor cartridge.

Figure 8:
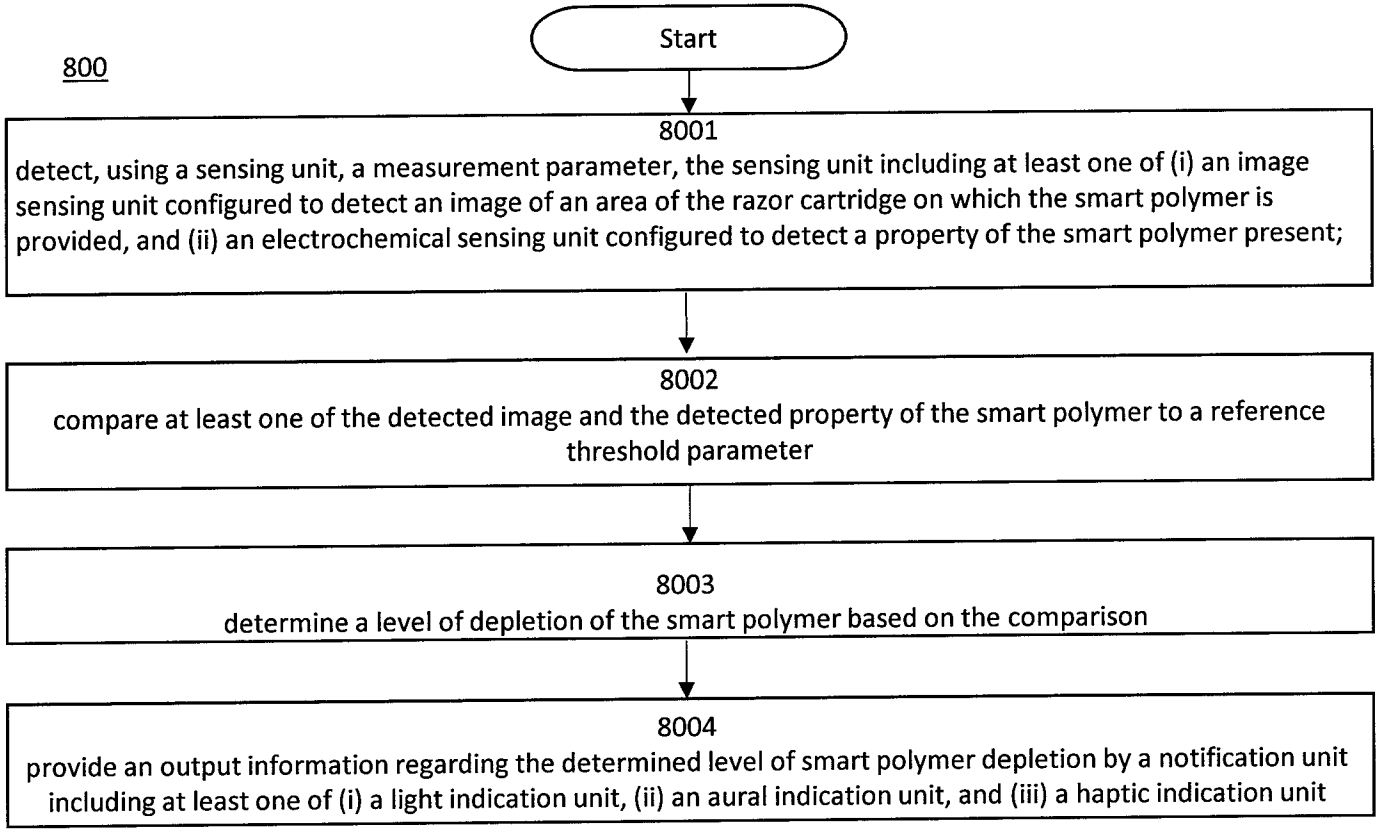
FIG. 8 is a logic flow chart of a method according to another exemplary embodiment.

FIG. 8 illustrates a logic flow 800 of an exemplary method for determining a level of depletion of the smart polymer provided on a razor according to an embodiment of the present disclosure. At block 8001, a measurement parameter is detected using a sensing unit (e.g., image sensor 6002 and/or electrochemical sensor 6115 provided on the razor and/or in the base unit or module 6020), the sensing unit including at least one of (i) an image sensing unit (e.g., 6002) configured to detect an image of an area of the razor cartridge on which the smart polymer 1150 is provided, and (ii) an electrochemical sensing unit (e.g., 6115) configured to detect a property of the smart polymer 1150 present. At block 8002, the at least one of the detected image and the detected property of the smart polymer 1150 is compared to a reference threshold parameter, e.g., by control unit 6004, base control unit circuitry 6021, computer 6030 and/or mobile device 6040. At block 8003, a level of depletion of smart polymer 1150 is determined, e.g., by control unit 6004, base control unit circuitry 6021, computer 6030 and/or mobile device 6040, based on the comparison of the at least one of the detected image and the detected property of the smart polymer to the reference threshold parameter. At block 8004, output information regarding the determined level of smart polymer depletion is provided by a notification unit (e.g., 6003*a*) including at least one of (i) a light indication unit, (ii) an aural indication unit, and (iii) a haptic indication unit.

Figure 9:
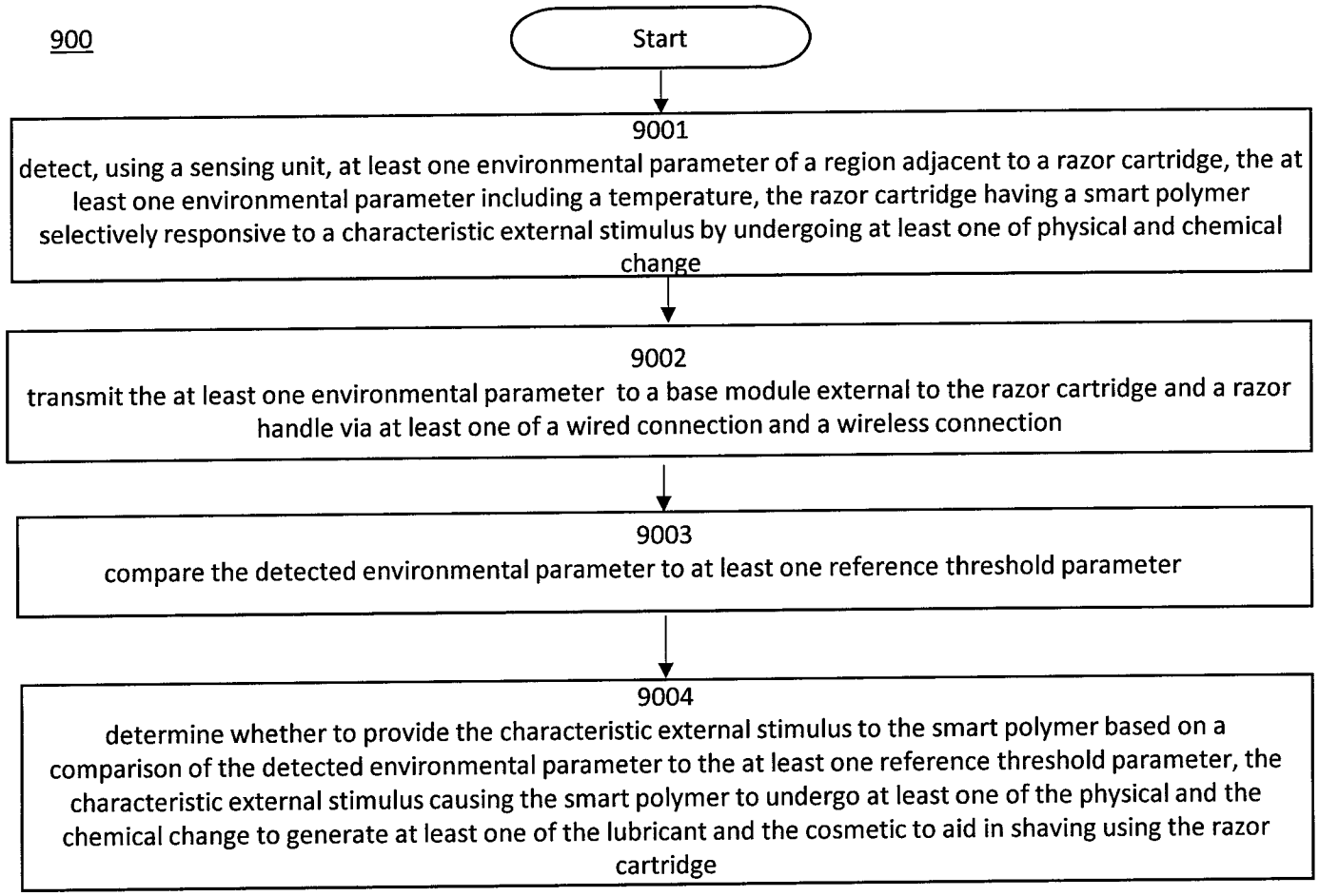
FIG. 9 is a logic flow chart of a method according to still another exemplary embodiment.

FIG. 9 illustrates a logic flow 900 of another method for adaptively releasing at least one of a lubricant and a cosmetic for a razor cartridge according to an embodiment of the present disclosure. At block 9001, at least one environmental parameter of a region adjacent to a razor cartridge is detected using a sensing unit (e.g., temperature sensor 6001). The at least one environmental parameter includes a temperature with the razor cartridge having a smart polymer selectively responsive to a characteristic external stimulus by undergoing at least one of physical and chemical change. At block 9002, the at least one detected environmental parameter is transmitted to a base module (e.g., base unit 6020, computer 6030 and/or mobile device 6040, each having a control app) external to the razor cartridge and a razor handle via at least one of a wired connection and a wireless connection. At block 9003, the detected environmental parameter is compared to at least one reference threshold parameter, e.g., by control unit 6004, base control unit circuitry 6021, computer 6030 and/or mobile device 6040. At block 9004, it is determined, e.g., by control unit 6004 and/or base control unit circuitry 6021, whether to provide the characteristic external stimulus to the smart polymer based on a comparison of the detected environmental parameter to the at least one reference threshold parameter with the characteristic external stimulus causing the smart polymer to undergo at least one of the physical and the chemical change to generate at least one of the lubricant and the cosmetic to aid in shaving using the razor cartridge.

Figure 10:
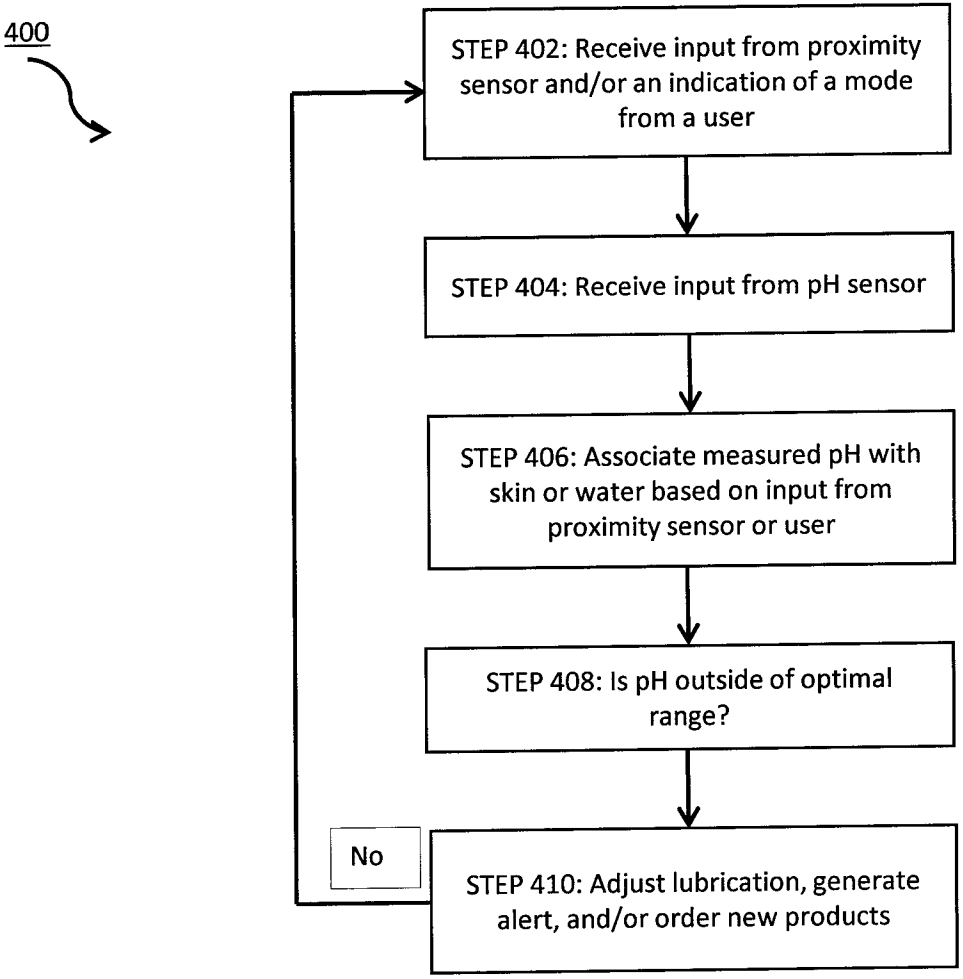
FIG. 10 is a logic flow chart of a method according to yet another exemplary embodiment.

A logic flow 400 of an exemplary method is shown in FIG. 10. One or more steps of method 400 may performed out of order or eliminated altogether. Method 400 may begin at step 402, where the processing unit (e.g., control unit 6004, base control unit circuitry 6021, computer 6030 and/or mobile device 6040) may receive input from proximity sensor 6111 and/or an indication of a mode (e.g., shaving or cleaning) from the user. Method 400 then may proceed to step 404, where the processing unit (e.g., control unit 6004, base control unit circuitry 6021, computer 6030 and/or mobile device 6040) may receive input from pH sensor 6112. Subsequently, method 400 may proceed to step 406, where, depending on the input received from proximity sensor 6111 or the user at step 402, the processing unit (e.g., control unit 6004, base control unit circuitry 6021, computer 6030 and/or mobile device 6040) may associate the pH values from pH sensor 6112 to the user's skin, shaving agent, or water used to clean the shaver 1, for example. Method 400 then may proceed to step 408, where the processing unit (e.g., control unit 6004, base control unit circuitry 6021, computer 6030 and/or mobile device 6040) may compare the measured pH to ranges for skin pH or water pH to determine whether the measured pH is outside of an optimal range. If the measured pH is within an expected or optimal range, method 400 may return to step 402. If the measured pH is outside of the expected or optimal range, method 400 may proceed to step 410, where the processing unit (e.g., control unit 6004, base control unit circuitry 6021, computer 6030 and/or mobile device 6040) may automatically adjust lubrication of the user's skin by e.g., dispensing a shaving agent or applying a stimulus to change a property (e.g., lubricity) of a smart polymer disposed on cartridge 100, as described above in greater detail. The processing unit (e.g., control unit 6004, base control unit circuitry 6021, computer 6030 and/or mobile device 6040) also may generate an alert at step 410 as set forth above. The alert could be audio, visual, or haptic feedback on shaver 1 itself or on a base associated with shaver 1. Or, the alert could be a notification on a device (e.g., smart phone or other computing device) of the user. The processing unit (e.g., control unit 6004, base control unit circuitry 6021, computer 6030 and/or mobile device 6040) also may suggest or automatically order replacement or supplemental shaving products that are optimized for the measured pH conditions.

It should be noted that the example techniques 400, 700, 800 and 900 illustrated in FIGS. 7-10 can be combined in part and/or entirely. For example, the technique 800 illustrated in FIG. 8 can be combined with the technique 700 shown in FIG. 7 and/or the technique 900 shown in FIG. 9. In addition, the technique 400 illustrated in FIG. 10 can be combined with one or more of the technique(s) 700, 800 and/or 900 shown in FIGS. 7-9. These examples are not limiting.

Figure 11:
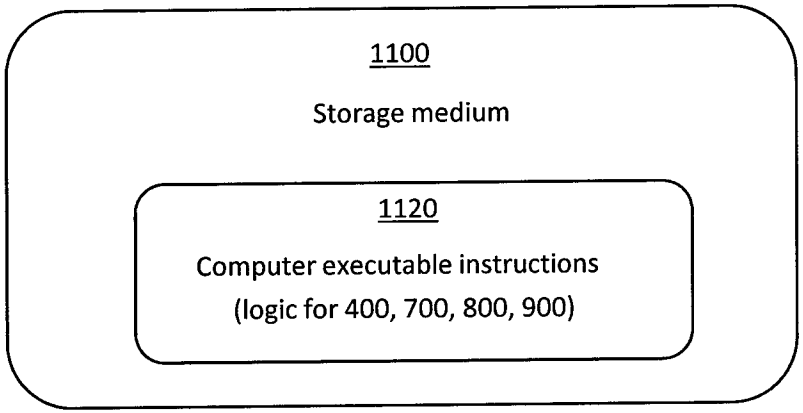
FIG. 11 is a computer-readable storage medium according to an embodiment herein.

FIG. 11 illustrates an embodiment of a storage medium 1100, which can comprise an article of manufacture, e.g., storage medium 1100 can include any non-transitory computer readable medium or machine-readable medium, such as an optical, magnetic or semiconductor storage. Storage medium 1100 can store various types of computer executable instructions, e.g., 1120. For example, storage medium 2000 can store various types of computer executable instructions to implement techniques 400, 700, 800, and 900. Further, such instructions can be executed by, e.g., control unit 6004, base unit circuitry 6021, computer 6030 and/or mobile device 6040, to carry out the techniques described herein.

Some examples of a computer readable storage medium or machine-readable storage medium can include tangible media capable of storing electronic data, e.g., volatile memory or non-volatile memory, removable or non-removable memory, erasable or non-erasable memory, writeable or re-writeable memory, and the like. Some examples of computer-executable instructions can include suitable type of code, e.g., source code, compiled code, interpreted code, executable code, static code, dynamic code, object-oriented code, visual code, and the like. The examples are not limited in this context.

Figure 12:
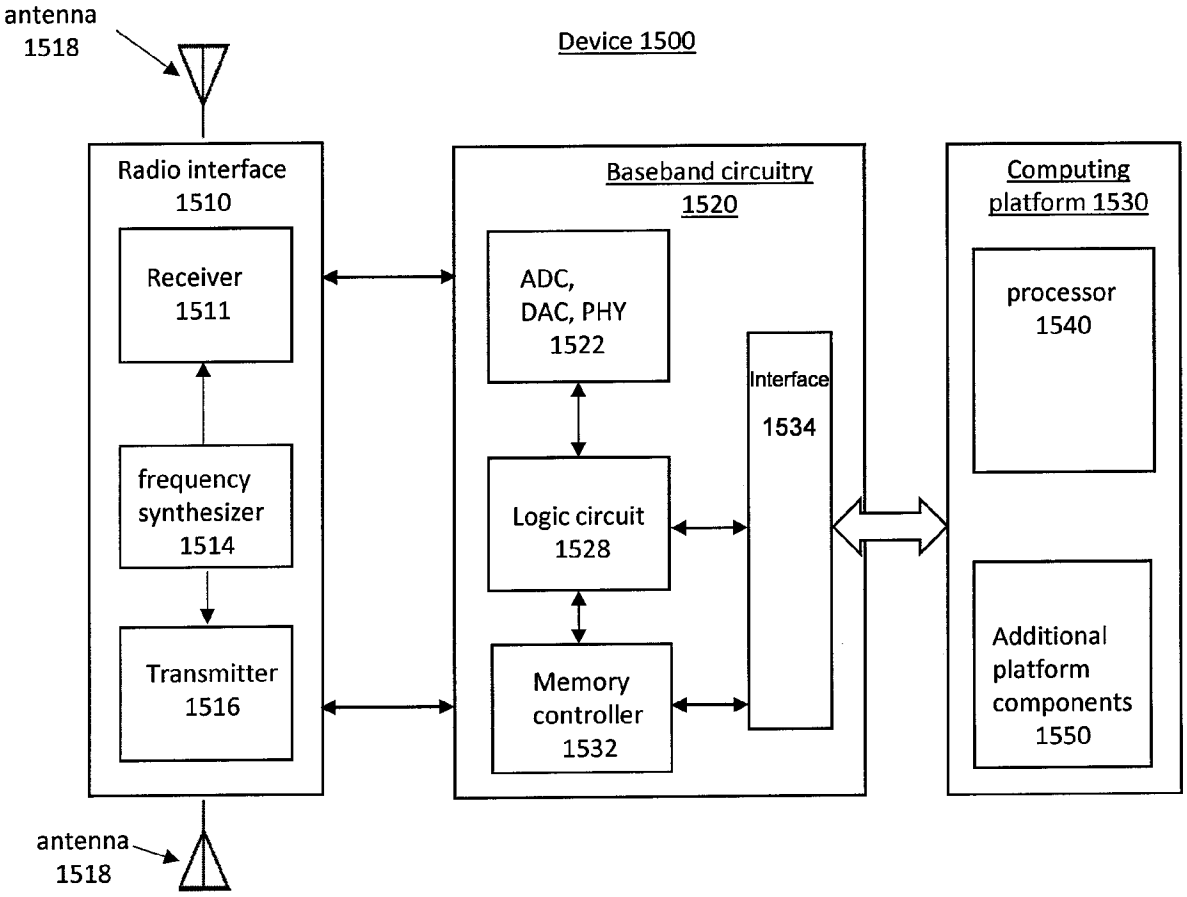
FIG. 12 is an embodiment of a communication device for implementing one or more logic flows herein.

FIG. 12 illustrates an embodiment of a communications device 1500 which can implement one or more of logic flow 400, logic flow 700, logic flow 800, and logic flow 900, storage medium 1100, the computer 6030, the mobile device 6040, one or more functionalities of the circuitry of razor 1, and one or more functionalities of base unit 6020, according to one or more embodiments. In an example embodiment, communication device 1500 can comprise a logic circuit 1528 which can include physical circuits to perform operations described for one or more of logic flow 400, logic flow 700, logic flow 800, and logic flow 900, for example. In addition, communication device 1500 can include a radio interface 1510, baseband circuitry 1520, and computing platform 1530. However, the embodiments are not limited to this example configuration.

Communication device 1500 can implement some or all of the structure and/or operations for one or more of logic flow 400, logic flow 700, logic flow 800, and logic flow 900, storage medium 1100, computer 6030, mobile device 6040, one or more functionalities of the circuitry of razor 1, one or more functionalities of base unit 6020, and logic circuit 1528 in (i) a single computing entity, e.g., a single device, or (ii) in a distributed manner. In the latter case, communication device 1500 can distribute portions of the structure and/or operations for one or more of logic flow 400, logic flow 700, logic flow 800, and logic flow 900, storage medium 1100, computer 6030, mobile device 6040, one or more functionalities of base unit 6020, and logic circuit 1528 across multiple computing platforms and/or entities using a distributed system architecture, e.g., a master-slave architecture, a client-server architecture, a peer-to-peer architecture, a shared database architecture, and the like. The embodiments are not limited in this context.

In an example embodiment, radio interface 1510 can include one or more component(s) adapted to transmit and/or receive single-carrier or multi-carrier modulated signals such as CCK (complementary code keying), OFDM (orthogonal frequency division multiplexing), and/or SC-FDMA (single-carrier frequency division multiple access) symbols. Radio interface 1510 can include, e.g., a receiver 1511, a frequency synthesizer 1514, a transmitter 1516, and one or more antennas 1518. However, the embodiments are not limited to these examples.

Baseband circuitry 1520, which communicates with radio interface 1510 to process receive signals and/or transmit signals, can include a unit 1522 comprising an analog-to-digital converter, a digital-to-analog converter, and a baseband or physical layer (PHY) processing circuit for physical link layer processing of receive/transmit signals. Baseband circuitry 1520 can also include, for example, a memory controller 1532 for communicating with a computing platform 1530 via an interface 1534.

Computing platform 1530, which can provide computing functionality for device 1500, can include a processor 1540 and other platform components 1550, e.g., processors, memory units, chipsets, controllers, peripherals, interfaces, input/output (I/O) components, power supplies, and the like.

Device 1500 can be, e.g., a mobile device, a smart phone, a fixed device, a machine-to-machine device, a personal digital assistant (PDA), a mobile computing device, a user equipment, a computer, a network appliance, a web appliance, consumer electronics, programmable consumer electronics, game devices, television, digital television, set top box, wireless access point, base station, subscriber station, mobile subscriber center, radio network controller, router, hub, gateway, and the like. These examples are not limiting.

Figure 13:
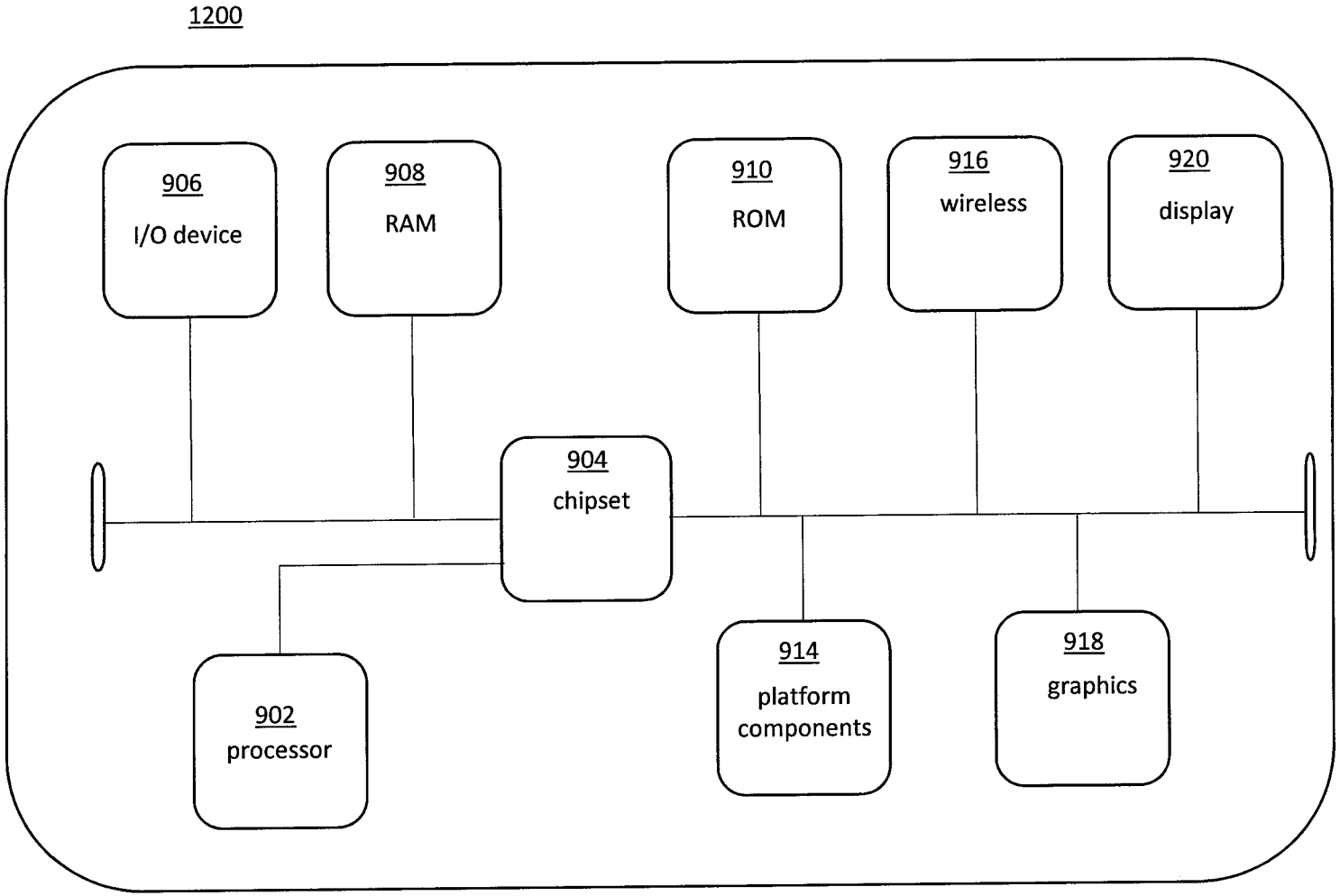
FIG. 13 is an embodiment of a system of the present disclosure.

FIG. 13 is an exemplary system embodiment configured as a platform 1200, which can include, e.g., a processor 902, a chipset 904, an I/O (input/output) device 906, a RAM (random access memory) 908, e.g., DRAM (dynamic RAM), and a ROM (read only memory) 910, a wireless communications chip 916, a graphics device 918, and a display 920, and other platform components 914 (e.g., a cooling system, a heat sink, vents, and the like), which are coupled to one another by way of a bus 312 and chipset 904. The examples are not limiting.

The techniques and embodiments described herein are exemplary, and should not be construed as implying any specific limitation on the present disclosure. It should be understood that various alternatives, combinations and modifications could be devised by those skilled in the art. For example, steps associated with the processes described herein can be performed in any order, unless otherwise specified or dictated by the steps themselves. The above description is illustrative, and is not intended to be restrictive. One of ordinary skill in the art may make numerous modifications and/or changes without departing from the general scope of the disclosure. For example, and as has been described, the above-described embodiments (and/or aspects thereof) may be used in combination with each other. Additionally, portions of the above-described embodiments may be removed without departing from the scope of the disclosure. In addition, modifications may be made to adapt a particular situation or material to the teachings of the various embodiments without departing from their scope. Many other embodiments will also be apparent to those of skill in the art upon reviewing the above description. The present disclosure is intended to embrace all such alternatives, modifications and variances that fall within the scope of the appended claims.

The terms "comprise" or "comprising" are to be interpreted as specifying the presence of the stated features, integers, steps or components, but not precluding the presence of one or more other features, integers, steps or components or groups thereof. The terms "a" and "an" are indefinite articles, and as such, do not preclude embodiments having pluralities of articles. It should be noted that all numeric values disclosed or claimed herein (including all disclosed values, limits, and ranges) may have a variation of +/−10% (unless a different variation is specified) from the disclosed numeric value. Moreover, in the claims, values, limits, and/or ranges means the value, limit, and/or range +/−10%.

Some embodiments may be described using the expression "one embodiment" or "an embodiment" along with their derivatives. These terms mean that a particular feature, structure, or characteristic described in connection with the embodiment is included in at least one embodiment. The appearances of the phrase "an embodiment" in various places in the specification are not necessarily all referring to the same embodiment.

The invention claimed is:

1. A system for adaptively releasing at least one of a lubricant or a cosmetic for a razor cartridge, comprising:
   at least one sensing unit configured to detect a property of at least one of skin, air, water or a chemical agent in a region adjacent to the razor cartridge; and
   a processing unit configured to control a release of the at least one of the lubricant or the cosmetic based at least on the property detected by the at least one sensing unit.

2. The system according to claim 1, further comprising:
   a further sensing unit comprising at least one of a proximity sensor or an electrochemical sensor;
   wherein the processing unit is configured to control the release of the at least one of the lubricant or the cosmetic by taking into consideration an output of the at least one of the proximity sensor or the electrochemical sensor.

3. The system according to claim 2, wherein the proximity sensor is configured to detect when the razor cartridge is in contact with skin.

4. The system according to claim 2, wherein the electrochemical sensor is configured to detect an electrochemical property of at least one of skin, air, water or a chemical agent in a region adjacent to the razor cartridge.

5. The system according to claim 2, further comprising:
   a notification unit comprising at least one of (i) a light indication unit configured to output information regarding a determined level of depletion of a smart polymer, (ii), an aural indication unit configured to output information regarding the determined level of depletion of the smart polymer, or (iii) a haptic indication unit configured to output information regarding the determined level of depletion of the smart polymer, wherein the notification unit is configured to provide an indication to replace the razor cartridge.

6. The system according to claim 1, wherein the property of water includes temperature, pH, or weight.

7. A method for adaptively releasing at least one of a lubricant and a cosmetic for a razor cartridge, comprising:
   detecting, using at least one sensing unit, a property of at least one of skin, air, water or a chemical agent in a region adjacent to the razor cartridge; and
   controlling, using a processing unit, a release of the at least one of the lubricant and the cosmetic based at least on the property detected by the at least one sensing unit.

8. The method according to claim 7, wherein the property of water includes temperature, pH, or weight.

9. A system for adaptively releasing at least one of a lubricant or a cosmetic for a razor cartridge, comprising:
   at least one sensing unit configured to detect a property of at least one of skin, air, or a chemical agent in a region adjacent to the razor cartridge; and a processing unit configured to control a release of the at least one of the lubricant or the cosmetic based at least on the property detected by the at least one sensing unit.

10. The system according to claim 9, wherein the property of at least one of skin, air, or a chemical agent includes temperature, pH, humidity, redox, weight, electrical stimulus, chemical stimulus, light wavelength, light intensity, electric field, magnetic field, and/or electrochemical stimulus.

11. The system according to claim 9, further comprising:

a smart polymer provided on the razor cartridge and selectively responsive to a characteristic external stimulus by undergoing at least one of physical or chemical change;

wherein the processing unit is configured to control the release of the at least one of the lubricant or the cosmetic by providing the characteristic external stimulus to cause the smart polymer to undergo at least one of a physical change or a chemical change.

12. The system according to claim 11, wherein the characteristic external stimulus is electrical current.

13. The system according to claim 11, wherein:

the at least one sensing unit comprises a temperature sensor configured to detect a temperature; and wherein the processing unit is configured to:

(i) compare the detected temperature to at least one reference threshold parameter comprising one of a specified temperature level or a specified temperature range; and (ii) determine whether to provide the characteristic external stimulus to the smart polymer based on a comparison of the detected temperature to the at least one reference threshold parameter, wherein the characteristic external stimulus causes the smart polymer to undergo at least one of the physical change and the chemical change to generate at least one of the lubricant or the cosmetic to aid in shaving while using the razor cartridge.

14. The system according to claim 11, further comprising:

a further sensing unit configured to detect a measurement parameter, the further sensing unit comprising at least one of (i) an image sensing unit configured to detect an image of an area of the razor cartridge on which the smart polymer is provided, or (ii) an electrochemical sensing unit configured to detect a property of the smart polymer present;

wherein the processing unit is configured to compare at least one of the detected image or the detected property of the smart polymer to a reference threshold parameter, and determine a level of depletion of the smart polymer based on the comparison.

15. The system according to claim 14, wherein at least one of the detected measurement parameter or the determined level of depletion of the smart polymer is transmitted to a base module external to the razor cartridge and a razor handle operatively connected to the razor cartridge via at least one of a wired connection or a wireless connection.

16. The system according to claim 14, wherein the further sensing unit is provided in a base module external to the razor cartridge and a razor handle operatively connected to the razor cartridge.

17. The system according to claim 14, further comprising:

a notification unit comprising at least one of (i) a light indication unit configured to output information regarding the determined level of depletion of the smart polymer, (ii) an aural indication unit configured to output information regarding the determined level of depletion of the smart polymer, or (iii) a haptic indication unit configured to output information regarding the determined level of depletion of the smart polymer, wherein the notification unit is configured to provide an indication to replace the razor cartridge.

18. The system according to claim 9, further comprising:

a further sensing unit comprising at least one of a proximity sensor or an electrochemical sensor;

wherein the processing unit is configured to control the release of the at least one of the lubricant or the cosmetic by taking into consideration an output of the at least one of the proximity sensor or the electrochemical sensor.

19. The system according to claim 18, wherein the proximity sensor is configured to detect when the razor cartridge is in contact with skin.

20. The system according to claim 18, wherein the electrochemical sensor is configured to detect an electrochemical property of at least one of skin, air, water or a chemical agent in a region adjacent to the razor cartridge.

* * * * *